US008712300B2

(12) United States Patent
Mukai

(10) Patent No.: US 8,712,300 B2
(45) Date of Patent: Apr. 29, 2014

(54) FUSING APPARATUS AND IMAGE FORMING APPARATUS PROVIDED WITH THE SAME, AND HEATING APPARATUS

(75) Inventor: Takashi Mukai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 231 days.

(21) Appl. No.: 13/197,507

(22) Filed: Aug. 3, 2011

(65) Prior Publication Data

US 2012/0045261 A1 Feb. 23, 2012

(30) Foreign Application Priority Data

Aug. 19, 2010 (JP) ..... 2010-184285

(51) Int. Cl.
*G03G 15/20* (2006.01)

(52) U.S. Cl.
USPC ..... 399/329

(58) Field of Classification Search
USPC ..... 399/67, 122, 320, 328, 329; 219/543
See application file for complete search history.

(56) References Cited

U.S. PATENT DOCUMENTS

| | | | | |
|---|---|---|---|---|
| 5,303,016 | A * | 4/1994 | Oda et al. | 399/329 |
| 6,084,208 | A * | 7/2000 | Okuda et al. | 219/216 |
| 6,212,356 | B1 | 4/2001 | Ishikawa et al. | |
| 7,203,438 | B2 * | 4/2007 | Omata et al. | 399/69 |
| 2009/0263171 | A1 * | 10/2009 | Kageyama | 399/329 |
| 2010/0303525 | A1 * | 12/2010 | Mitsuoka et al. | 399/329 |

FOREIGN PATENT DOCUMENTS

| | | | |
|---|---|---|---|
| JP | 5-88566 | A | 4/1993 |
| JP | 7-201455 | A | 8/1995 |
| JP | 2004-55395 | A | 2/2004 |
| JP | 2009-145575 | A | 7/2009 |
| JP | 2010-117598 | A | 5/2010 |
| WO | WO 99/00713 | A1 | 1/1999 |

* cited by examiner

*Primary Examiner* — Clayton E Laballe
*Assistant Examiner* — Victor Verbitsky
(74) *Attorney, Agent, or Firm* — Birch, Stewart, Kolasch & Birch, LLP

(57) ABSTRACT

A fusing apparatus includes a heating element generating heat to fix a toner image onto a sheet; a rigid member conducting the heat to an endless belt and arranged to contact the heating element and the endless belt; and a pressure member pressing the heating element against the rigid member. The endless belt contacts the sheet, the heating element includes an elongated substrate extending in a widthwise direction of the endless belt, plural resistance heating layers formed on a surface of the substrate along a longitudinal direction thereof and arranged parallel to one another, and at least one conduction portion formed in at least one place of an intermediate region between one end and another of each resistance heating layer to connect the different resistance heating layers, and the pressure member presses the heating element against the rigid member at a position other than where the conduction portion is formed.

8 Claims, 11 Drawing Sheets

FUSING APPARATUS AND IMAGE FORMING APPARATUS PROVIDED WITH THE SAME, AND HEATING APPARATUS

CROSS-REFERENCE TO RELATED APPLICATION

This application is related to Japanese Patent Application No. 2010-184285 filed on Aug. 19, 2010, whose priority is claimed and the disclosure of which is incorporated by reference in its entirety.

BACKGROUND OF THE INVENTION

1. Field of the Invention

The present invention relates to a fusing apparatus used in an electrophotographic system, an image forming apparatus provided with the same, and a heating apparatus having a sheet heating element.

2. Description of the Related Art

An image forming apparatus using an electrophotographic process (hereinafter merely referred to as an "image forming apparatus") includes a photoconductor, a charging unit, an exposure unit, a developing unit, a transfer unit, and a fusing unit, for example. The image forming apparatus performs a charging process, an exposure process, a developing process, a transfer process, and a fusing process with the use of the photoconductor and these units, whereby forming an image onto a sheet-type recording medium (hereinafter merely referred to as a "sheet").

A fusing apparatus of a thermal roller fusing system is used, for example, as the fusing unit that performs the fusing process. The fusing apparatus of the thermal roller fusing system includes a fuser roller and a pressure roller. The fuser roller and the pressure roller are a pair of rollers that are in pressed contact with each other. At least either one of the fuser roller and the pressure roller includes a heat source serving as a heating unit, such as a halogen heater, mounted therein.

In the fusing process, the heat source heats the roller pair to a predetermined temperature required for the fusing (hereinafter referred to as a "fusing temperature"). Thereafter, the recording medium having a non-fused toner image formed thereon is conveyed to a fuser nip portion that is a press-contact portion between the fuser roller and the pressure roller. The non-fused toner image is fused onto the recording medium such as a sheet due to the heat transmitted from at least either one of the fuser roller and the pressure roller and the pressure from the fuser roller and the pressure roller, when it passes through the fuser nip portion. Although the temperature of the portion of the nip portion where the recording medium passes (hereinafter referred to as a "sheet passing portion") is decreased, the temperature of the sheet passing portion then rises to the fusing temperature, since the heat is supplied from the heat source.

A fusing apparatus provided to an image forming apparatus capable of performing a full-color printing uses a fuser roller provided with an elastic layer made of a silicon rubber on its surface (hereinafter referred to as an "elastic roller"). For forming a full-color image in which a plural colors of toners are used, more toner needs to be fused compared to the case of a monochrome image. When the elastic roller is used, the surface of the elastic roller is elastically deformed corresponding to irregularities on the non-fused toner image at the fuser nip portion. Specifically, the elastic roller and the non-fused toner image are brought into contact with each other as if the elastic roller covers the non-fused toner image. Therefore, a fusibility for fusing the full-color image, which uses a lot of toner, can be enhanced. A releasing performance of a color toner, which is liable to be offset compared to a monochrome image, can be enhanced due to an effect of releasing a distortion of the elastic layer on the surface of the elastic roller. Specifically, on the elastic layer that is compressed and deformed at the fuser nip portion, the deformation is released at an exit of the fuser nip portion. Therefore, a deviation is generated between the elastic layer and the toner image at the exit of the fuser nip portion. As a result, an adhesion force of the elastic layer to the toner image is reduced, resulting in that the releasing performance is enhanced. Since the elastic layer is deformed to have a concave shape due to the press-contact between the fuser roller and the pressure roller at the fuser nip portion, the shape (nip shape) of the path through which the recording medium passes becomes convex toward the fuser roller. Therefore, the curvature of the surface of the fuser roller at the portion where the recording medium is separated from the fuser roller increases, resulting in that a separation property of the recording medium can be enhanced. As a result, a structure of being capable of separating the recording medium from the fuser roller (self-stripping structure) can be realized without providing an auxiliary separating unit, e.g., a separating claw, for separating the recording medium from the fuser roller. This structure can avoid the formation of a defective image caused by the separating unit.

In order to respond to an increased speed in an image formation, the width of the fuser nip portion (hereinafter referred to as "fuser nip width") is necessarily widened. There are two methods, which are a method of increasing the thickness of the elastic layer of the elastic roller, and a method of increasing the diameter of the elastic roller, as a method of increasing the fuser nip width. However, a thermal conductivity of the elastic layer of the elastic roller is extremely low. When the thickness of the elastic layer of the elastic roller increases in a structure in which the heating unit is provided in the elastic roller as in the conventional case, a thermal conductivity from the inside of the elastic roller to the surface thereof is deteriorated, which might increase a warm-up time. When a process speed involved with the image formation is increased, a peripheral speed of the fuser roller has to be increased corresponding to the increased process speed. However, the recovery of the temperature of the fuser roller, which is reduced at the sheet passing portion, is too late, which entails a problem that the temperature of the fuser roller cannot follow the fusing temperature. When the diameter of the elastic roller is increased in order to secure the time for the temperature recovery, a power consumption of the heating unit might increase.

A fusing apparatus of a belt fusing system is described in Pamphlet of International Publication No. WO99/00713 in order to solve the foregoing problems. The belt fusing system includes a fuser roller, a pressure roller, a heat roller, and an endless belt. The endless belt is stretched between the heat roller having a heater provided therein and the fuser roller, wherein the fuser roller and the pressure roller are in contact with each other via the endless belt. In the belt fusing system, the heat roller serving as the heating unit heats the endless belt having a small heat capacity, whereby a warm-up time can be shortened, compared to the structure in which the elastic layer having a large heat capacity is heated. Since the heating unit does not have to be incorporated in the fuser roller, the deterioration in the thermal conductivity does not become a problem, even if the elastic layer made of a sponge rubber, for example, having a low hardness is formed to be thick, resulting in that the wide fuser nip portion can be secured.

Japanese Unexamined Patent Publication No. 7-201455 proposes a fuser of a film heating system. In the film heating system, a sheet heating element is used as the heating unit, wherein a heat from the heating unit is applied to a recording material, serving as a material to be heated, through a film. A non-fused image on the recording material is fused by the heat as a permanent image.

In the fusing apparatus of the film heating system, the heat capacity of the sheet heating element is smaller than the heat capacity of a conventional halogen lamp heater. Specifically, the heat capacity of the heating unit can be reduced more than in the conventional case, whereby power saving can be attained, and the warm-up time can be shortened.

The present inventors have developed a fusing apparatus using a fuser belt of an endless belt type. A fuser apparatus according to the present invention includes a fuser belt that is stretched between a fuser roller and a tension roller to form a loop-type moving path, wherein a heating member is brought into contact with an inner side of the stretched fuser belt so as to heat the fuser belt, as illustrated in a later-described FIG. 3. The fuser belt is in contact with a pressure roller at a press-contact point between the fuser roller and the pressure roller opposite to the fuser roller. A recording medium having a toner image transferred thereon is guided to the press-contact point between the pressure roller and the fuser belt, wherein the toner image is heated and fused by the fuser belt to be fixed onto the recording medium.

The heating member includes, in this order from the fuser belt, a heat-conductor, a sheet heating element, a heat insulating member, a pressure member, and a reinforcing member.

As illustrated in a later-described FIGS. 5A and 5B, the sheet heating element includes plural resistance heating layers that are formed on a surface of a substrate which has a slender shape in a widthwise direction so as to extend in a longitudinal direction of the substrate. One end and the other end of each of the resistance heating layers are connected by end electrodes. A conduction portion extending in the widthwise direction of the substrate is formed at plural places at a middle portion sandwiched between the end electrodes at both ends, wherein the different resistance heating layers are connected by the conduction portion. The heat-conductor is made of a material having excellent thermal conductivity such as an aluminum that is a rigid body. The pressure member presses the sheet heating element against the heat-conductor so as to efficiently transfer a heat from the sheet heating element to the fuser belt.

In the fusing apparatus having the above-mentioned configuration, the present inventors have found problems described below involved with a setting of a pressure position where the sheet heating element is pressed against the heat-conductor.

(1) Pressure Position at Central Portion in Longitudinal Direction of Substrate

In the present invention, the conduction portion is formed at plural positions in the longitudinal direction for connecting in the widthwise direction of the substrate the different resistance heating layers, in order to average a variation in the resistance of the respective parallel resistance heating layers in the longitudinal direction of the substrate. The resistance heating layers are divided into several blocks in the longitudinal direction thereof by forming the conduction portion, wherein the respective blocks are electrically connected in series. This is to average a variation in a unit of the block so as to reduce a temperature unevenness, even if there is the variation in the resistance value of the parallel resistance heating layers composing each block.

When the pressure position is close to the conduction portion in this case, the substrate thermally expands at the adjacent conduction portions to warp, with the result that a gap is formed between the sheet heating element and the heat-conductor. When the gap is locally formed in the longitudinal direction of the substrate, a transfer of the heat at this portion is hindered, resulting in that the temperature of the sheet heating element is locally increased. If so, this portion further expands thermally, which causes a significant warp. In an extreme case, the substrate is broken, or the resistance heating layer is fused by the heat, so that a uniform heat generation cannot be attained. Although the substrate is not broken or the substrate does not become defective, a problem arises in which a temperature unevenness is caused in the longitudinal direction of the substrate.

(2) Pressure Position at End in Longitudinal Direction of Substrate

As for the pressure position in the vicinity of the end of the sheet heating element, when the pressure position is set within a fixed range closer to the center than to the end of the resistance heating layer, the sheet heating element thermally expands to warp, resulting in that a gap is formed between the heat-conductor and the sheet heating element. As a result, the substrate is broken, or the resistance heating layer is locally fused, as in the case of (1). Although the substrate is not broken or the substrate does not become defective, a problem arises in which a temperature unevenness is caused in the longitudinal direction of the substrate.

These problems are unique to the present structure in which the sheet heating element is pressed against the rigid member. Specifically, Pamphlet of International Publication No. WO99/00713 and the present invention are different from each other in that the sheet heating element is pressed against the elastic member such as the pressure roller or the rigid member such as a member made of an aluminum. According to the configuration of the present invention, there is no chance that the sheet heating element is pressed against the elastic member having large heat capacity, whereby the configuration is advantageous from a viewpoint of power saving and shortening the warm-up time. On the contrary, Pamphlet of International Publication No. WO99/00713 describes the configuration in which the sheet heating element is pressed against the pressure roller, which is the elastic member, via the fuser belt, so that this configuration is disadvantageous in power saving and shortening the warm-up time. However, the deformation of the sheet heating element due to the warp is absorbed by the pressure roller, which is the elastic member, so that a gap is difficult to be formed. Therefore, the gap is not formed between the sheet heating element and the pressure roller, which means the problem in the present invention involved with the pressure position hardly arises.

SUMMARY OF THE INVENTION

The present invention has been accomplished based upon the above-mentioned knowledge that has been found by the present inventors, and aims to provide a stable and robust fusing apparatus that can attain a uniform heating, while achieving power saving and shortening the warm-up time, and that is not broken or that is not defective. More specifically, in the fusing apparatus having a configuration in which a sheet heating element is pressed against a rigid member serving as a heat-conductor, an appropriate position for pressing the sheet heating element is selected, whereby a uniform heating and a robust and stable configuration can be realized.

The present invention provides (1) a fusing apparatus including: a sheet heating element for generating heat to fix a toner image being transferred onto a sheet; an endless belt being rotatably stretched by a stretching member; a rigid member for conducting the heat to the endless belt as a heat-conductor, the rigid member being arranged to contact with the sheet heating element and the endless belt respectively; and a pressure member for pressing the sheet heating element against the rigid member, wherein the endless belt is arranged to contact with the sheet, the sheet heating element includes an elongated substrate extending in a widthwise direction of the endless belt perpendicular to the rotating direction thereof, a plurality of parallel resistance heating layers which are formed on a surface of the substrate along a longitudinal direction of the substrate, and at least one conduction portion formed in at least one place of an intermediate region between one end and another of each resistance heating layer to connect the different resistance heating layers, and wherein the pressure member presses the sheet heating element against the rigid member at a position other than positions where the conduction portion is formed.

The present invention also provides an image forming apparatus provided with the fusing apparatus.

The present invention also provides (2) a heating apparatus including: a sheet heating element for generating heat to fix a toner image being transferred onto a sheet, the sheet heating element including an elongated substrate, a plurality of parallel resistance heating layers which are formed on a surface of the substrate along a longitudinal direction thereof and arranged parallel to one another, and at least one conduction portion formed in at least one place of an intermediate region between one end and another of each resistance heating layer to connect the different resistance heating layers; a rigid member in contact with an object to be heated for conducting the heat from the sheet heating element to the object; and a pressure member for pressing the sheet heating element against the rigid member, wherein the pressure member presses the sheet heating element against the rigid member at a position other than a position where the conduction portion is formed.

The present invention also provides (3) a fusing apparatus including: an endless belt being arranged to contact with a sheet with a toner image being transferred thereon; a pair of rollers for sandwiching the endless belt from inside and outside to rotate the endless belt and conveying the sheet with the toner image by sandwiching the sheet as well as the endless belt; a sheet heating element for generating heat to fix the toner image onto the sheet; a rigid member for conducting the heat to the endless belt as a heat-conductor, the rigid member being arranged to contact with the sheet heating element and the endless belt, respectively and stretch the endless belt; a pressure member for pressing the sheet heating element against the rigid member; and a counter member arranged to be opposite to the rigid member via the endless belt; wherein the counter member presses the endless belt against the rigid member.

The present invention also provides (4) a fusing apparatus comprising: a sheet heating element for generating heat to fix a toner image being transferred onto a sheet; an endless belt being rotatably stretched by two or more stretching members; a rigid member for conducting the heat to the endless belt as a heat-conductor, the rigid member being arranged to contact with the sheet heating element and the endless belt, respectively; a pressure member for pressing the sheet heating element against the rigid member; and a counter member arranged to oppose to the rigid member via the endless belt; wherein the rigid member and the counter member are arranged between the stretching members, and the counter member presses the endless belt against the rigid member.

DETAILED DESCRIPTION OF THE INVNETION

Figure 1:
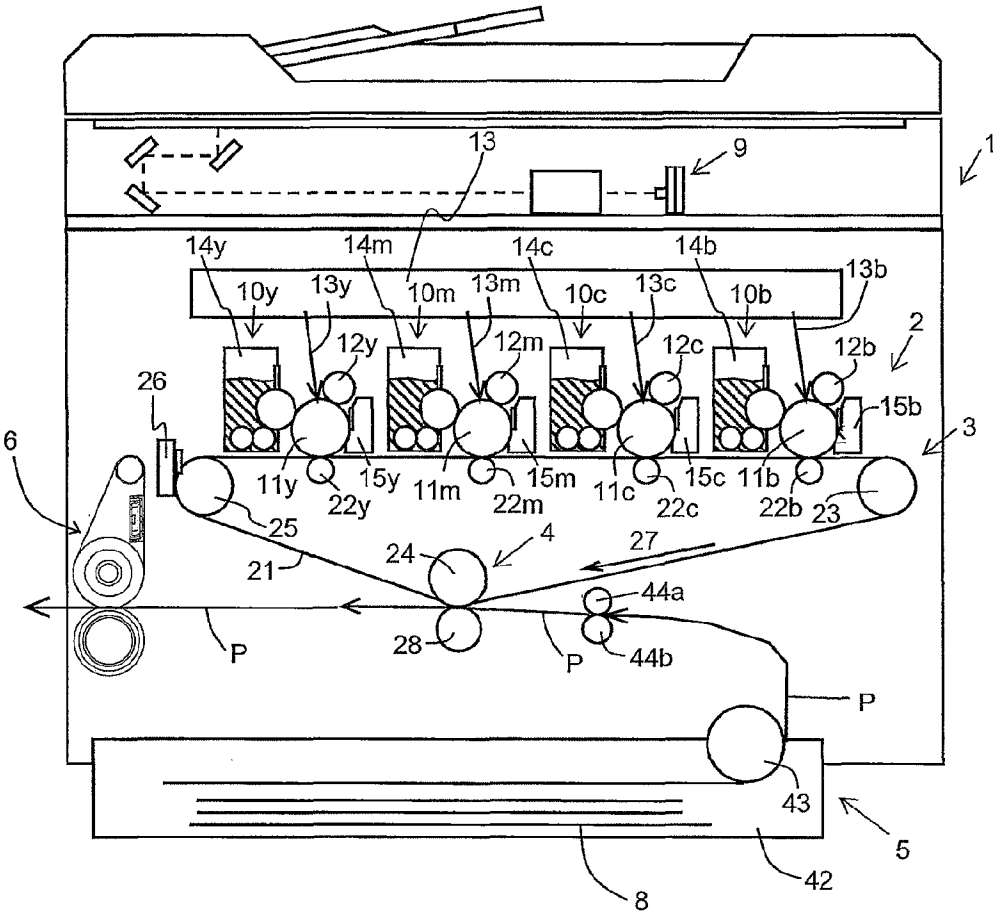
FIG. 1 is an explanatory view schematically illustrating a configuration of an image forming apparatus according to one embodiment of the present invention.

In the fusing apparatus in (1) of the present invention, the sheet heating element includes plural parallel resistance heating layers extending in the longitudinal direction of the substrate, and a conduction portion that is formed on at least one portion at the middle portion sandwiched between one end and the other end of the respective resistance heating layers so as to connect the different resistance heating layers, wherein the pressure member presses the sheet heating element against the rigid member in the longitudinal direction of the substrate except for the portion where the conduction portion is formed. Therefore, the pressure member presses the resistance heating layer, which generates heat during an energization, except for the portion of the conduction portion that generates less heat, in other words, the pressure member presses against the portion having a large thermal expansion, in order to effectively prevent the formation of a gap between the substrate and the heat-conductor due to the thermal expansion. Specifically, an appropriate position for pressing the sheet heating element is selected, whereby the fusing apparatus that attains a uniform heating and that has a robust and stable configuration can be realized.

The heating apparatus in (2) includes the sheet heating element having plural parallel resistance heating layers extending in the longitudinal direction of the substrate, and a conduction portion that is formed on at least one portion at the middle portion sandwiched between one end and the other end of the respective resistance heating layers so as to connect the different resistance heating layers; the rigid member that conducts the heat from the sheet heating element to an object to be heated; and a pressure member that presses the sheet heating element against the rigid member, wherein the pressure member presses the sheet heating element against the rigid member in the longitudinal direction of the substrate except for the portion where the conduction portion is formed. Therefore, the pressure member presses the resistance heating layer, which generates heat during an energization, except for the portion of the conduction portion that generates less heat, in other words, the pressure member presses against the portion having a large thermal expansion, in order to effectively prevent the formation of a gap between the substrate and the heat-conductor due to the thermal expansion. Specifically, an appropriate position for pressing the sheet heating element is selected, whereby the fusing apparatus that attains a uniform heating and that has a robust and stable configuration can be realized.

The fusing apparatus described in (3) includes the rigid member that functions as the heat-conductor and that stretches the endless belt, and the counter member that is arranged so as to be opposite to the rigid member via the endless belt, wherein the counter member presses the endless belt against the rigid member. Therefore, this configuration can effectively prevent the formation of the gap between the rigid member serving as the heat-conductor and the endless belt. Accordingly, the endless belt can efficiently and uniformly be heated.

The fusing apparatus described in (4) includes the rigid member serving as the heat-conductor, and the counter member that is arranged so as to be opposite to the rigid member, wherein the rigid member and the counter member are arranged between two stretching members, and the counter member presses the endless belt against the rigid member. Therefore, this configuration can effectively prevent the formation of the gap between the rigid member serving as the heat-conductor and the endless belt. Accordingly, the endless belt can efficiently and uniformly be heated.

The fusing apparatus according to the present invention heats the endless belt to fuse the toner image transferred onto a sheet-type transfer material with the heat, thereby fixing the toner image onto the transfer material. An image forming apparatus of an electrophotographic system generally has the fusing apparatus of this type. The present invention is applicable to an apparatus other than the electrophotographic system, so long as it heats a toner and fuses the toner onto a sheet, regardless of image forming systems. In a later-described embodiment, the fusing apparatus corresponds to a fusing portion.

The heating apparatus according to the present invention is a heat source preferable to the fusing apparatus, and is a long slender apparatus including a plane or plate-like heating element, a rigid member whose surface is preferably formed into a humpbacked shape having a gentle curvature, and a pressure member that presses the heating element against the rigid member. The heating apparatus heats the subject to be heated with the surface of the rigid member being in contact with the subject to be heated. In the later-described embodiment, the heating apparatus corresponds to a heating member.

The image forming apparatus according to the present invention includes the fusing apparatus. The specific example thereof is a printing apparatus of an electrophotographic system.

The sheet is a recording medium on which an image, which is to be printed thereon, is formed with a toner and fused. The typical example of the sheet is a print sheet. However, the sheet is not limited to a paper. The sheet may be a transparent resin used for an overhead projector, or a non-transparent resin.

In the fusing apparatus according to the present invention, the endless belt is brought into intimate contact with the sheet as being heated by the heating member so as to allow the toner transferred onto the sheet to be fused on the sheet. In the later-described embodiment, the endless belt corresponds to a fuser belt. The specific embodiment thereof is a belt having a silicon rubber, serving as an elastic layer, with a thickness of about 150 μm coated on a polyimide base having a thickness of about 100 μm, and a fluorine resin coated thereon in order to enhance a releasing performance. It is to be noted that the belt is not limited thereto, so long as it has a heat resistance property and flexibility.

The stretching members stretch the endless belt so as to be rotatable. The specific example thereof is a roller or a member having a fan-like surface. The fuser belt is stretched on the stretching members. In the later-described embodiment, the stretching members correspond to a fuser roller and a tension roller. Alternatively, the heating member may have a fan-like surface, and serve as the stretching member as applying tension to the endless belt by the fan-like portion.

The sheet heating element is a heat source that heats the endless belt through an electric heating member, wherein at least the portion that is in contact with the electric heating member is planar. The specific embodiment thereof is an element formed in such a manner that a resistance pattern, having an alloy (AgPd) of silver and palladium as a major component, in a form of a paste is printed and sintered on a ceramic substrate having a reed shape, and an insulating material such as a glass is coated on its surface. The material for the substrate and the resistance and the production method are not limited thereto.

The resistance heating layer is a resistance body that generates heat when it is energized. The specific embodiment is the one formed by sintering a paste of silver and palladium as described above. The material and the production method are not limited thereto. In the present invention, plural resistance heating layers are arranged in parallel along the longitudinal direction of the substrate. A voltage is applied between one end and the other end of each of the resistance heating layers, whereby an electric current flows through the resistance heating layers. Accordingly, the resistance heating layers generate heat according to Joule heat.

The conduction portion is a conduction layer that is provided in a middle portion between one end and the other end of each of the resistance heating layers, which are arranged in parallel, in order to connect different resistance heating layers. Preferably, several conduction portions are formed in the middle part. The resistance heating layers are connected at several parts and divided into a block. Therefore, even if there is a local resistance variation in the resistance heating layers, the variation is averaged in a unit of the block, whereby the heat generation can be made uniform. The specific embodiment is, for example, the one formed by printing and sintering a conductive pattern, having silver as a major component, in the form of a paste.

The rigid member transfers the heat from the sheet heating element to the endless belt. The specific embodiment is, for example, a member that is made of an aluminum, and formed to have a convex shape in which the surface that is in contact with the sheet heating element is formed to be flat, but the surface that is in contact with the endless belt is formed to have a gentle curvature. A fluorine resin is coated on the surface of the rigid member. The material is not limited thereto, so long as it has a heat resistance property, and a high thermal conductivity. The fluorine resin is coated in order to satisfactorily move the endless belt in a sliding manner. However, the coating may not be performed.

The pressure member is a member for pressing the sheet heating element against the heat-conductor. The specific embodiment thereof is, for example, a plate spring made of a stainless. The material is not particularly limited, so long as it has a heat resistance property and elasticity.

A preferable embodiment of the present invention will be described below.

In the fusing apparatus described in (1) in the present invention, the sheet heating element may include plural conduction portions, and the pressure member may press the sheet heating element against the rigid member at a middle portion between two conduction portions adjacent each other. With this configuration, the position at the middle of the adjacent conduction portions, i.e., the position at the middle of the resistance heating layers that generate heat upon energization, can be pressed. Since the portion having a large thermal expansion is pressed, the formation of the gap between the substrate and the heat-conductor due to the thermal expansion can more effectively be prevented. Specifically, an appropriate position for pressing the sheet heating element is selected, whereby the fusing apparatus that attains a uniform heating and that has a robust and stable configuration can be realized.

Alternatively, the pressure member may press the sheet heating element against the rigid member at a position that is between two conduction portions adjacent each other and is more than or equal to 10 mm away from both of respective conduction portions. With this configuration, the portion sufficiently apart from the conduction portion that generates less heat during the energization, i.e., the portion having a large thermal expansion, can be pressed. Therefore, the formation of the gap between the substrate and the heat-conductor due to the thermal expansion can more effectively be prevented. Specifically an appropriate position for pressing the sheet heating element is selected, whereby the fusing apparatus that attains a uniform heating and that has a robust and stable configuration can be realized.

In the preferable embodiment of the present invention, one end of the rigid member may be substantially at a same position as one end of each resistance heating layer in the a longitudinal direction of the substrate, and the pressure member may press the sheet heating element against the rigid member at a position between the one end of each resistance heating layer and the conduction portion near the end of each resistance heating layer. With this configuration, although the substrate is liable to warp due to the thermal expansion with one end of the rigid member being defined as a support at the end of the substrate, the portion, where the resistance heating layer is present, between the position substantially equal to one end described above and the conduction portion closest to the position can be pressed. Accordingly, the formation of the gap between the end of the substrate and the heat-conductor can effectively be prevented. Specifically, an appropriate position for pressing the sheet heating element at the end of the substrate is selected, whereby the fusing apparatus that attains a uniform heating and that has a robust and stable configuration can be realized.

Further, the pressure member may press the sheet heating element against the rigid member at a middle portion between the one end of each resistance heating layer and the nearest conduction portion from the end of each resistance heating layer. With this configuration, at the end of the substrate, the position at the middle of one end of each of the resistance heating layers and the conduction portion, i.e., the portion at the middle of the resistance heating layers that generate heat during the energization, can be pressed. Accordingly, the formation of the gap between the substrate and the heat-conductor can effectively be prevented. Specifically, an appropriate position for pressing the sheet heating element is selected, whereby the fusing apparatus that attains a uniform heating and that has a robust and stable configuration can be realized.

Alternatively, the pressure member may press the sheet heating element against the rigid member at a position that locates between the one end of each resistance heating layer and the nearest conduction portion from the end of each resistance heating layer and that locates anywhere within more than or equal to 10 mm from the end of each resistance heating layer. With this configuration, although the substrate is liable to warp due to the thermal expansion with one end of the rigid member being defined as a support at the end of the substrate, the portion sufficiently apart from one end described above can be pressed. Accordingly, the formation of the gap between the substrate and the heat-conductor due to the thermal expansion can more effectively be prevented. Specifically, an appropriate position for pressing the sheet heating element is selected, whereby the fusing apparatus that attains a uniform heating and that has a robust and stable configuration can be realized.

The sheet heating element may have a resistance heating layer made of silver and palladium with a thickness of about 10 μm on a ceramic substrate having a thickness of about 0.8 mm.

The pressure member may be made of an elastic member, or may be made of a stainless plate spring.

The rigid member may be made of an aluminum.

In the fusing apparatus described in (3), the counter member may serves as a cleaning member for cleaning the endless belt. With this configuration, a function as the counter member and a function as a cleaning member can be realized with a simple configuration.

In the fusing apparatus described in (4), it may be configured as the counter member may serves as a cleaning member for cleaning the endless belt. With this configuration, a function as the counter member and a function as a cleaning member can be realized with a simple configuration.

Various preferable embodiments described above can be combined to each other.

The present invention will be described below in more detail with reference to the drawings. The description below is only illustrative for all points, and it should not be construed that the present invention is limited by the description below.

Embodiment 1

FIG. 1 is a diagram schematically illustrating a configuration of an image forming apparatus 1 that is one embodiment of the present invention. The image forming apparatus 1 includes an image forming portion 2, an intermediate transfer portion 3, a secondary transfer portion 4, a recording medium feeding portion 5, and a fusing portion 6 that is a fusing apparatus according to the present invention, as well as a display portion, an operation portion, and a control portion, which are not illustrated in FIG. 1.

The fusing portion 6 will be described below. The detailed configurations of the other portions will be described at the end of this specification.

(Fusing Portion)

Figure 3:
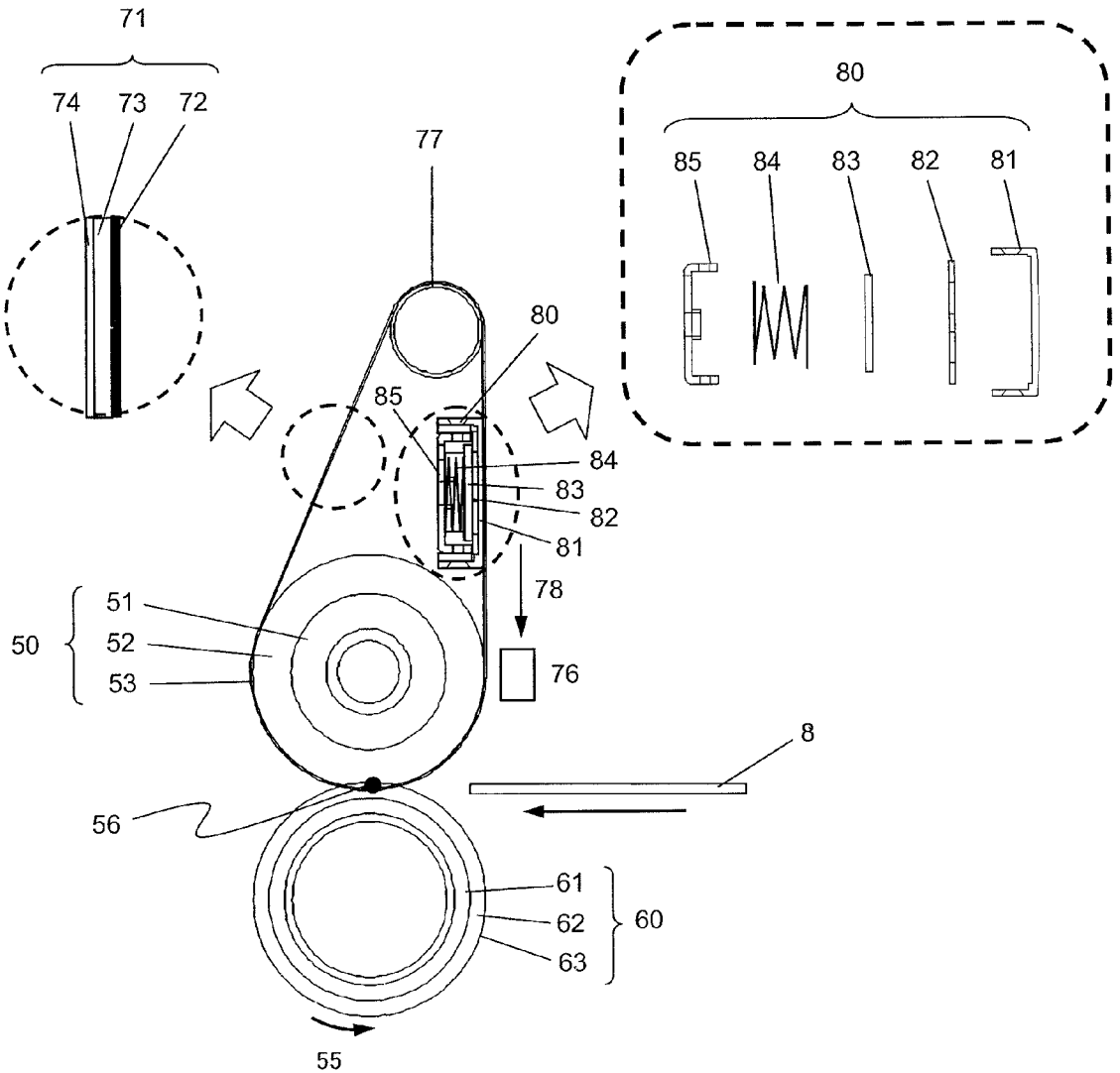
FIG. 3 is a sectional view illustrating an example of a detailed configuration of a fusing portion in the image forming apparatus illustrated in FIG. 1.

FIG. 3 is a sectional view illustrating the configuration of the fusing portion 6. The fusing portion 6 serving as a fusing unit includes a fuser belt 71, a fuser roller 50, a tension roller 77, a heating member 80, and a pressure roller 60.

The fuser belt 71 is an endless belt-like member that is stretched between the fuser roller 50 and the tension roller 77 for forming a loop-type moving path. The fuser belt 71 is mounted so as to be in contact with the pressure roller at a press-contact point between the fuser roller 50 and the pressure roller 60. The fuser belt 71 heats and fuses a toner, forming a toner image carried onto a recording medium 8, to be fixed onto the recording medium 8. The fuser belt 71 rotates in a direction of an arrow 78 with the rotation of the pressure roller 60 in a direction of an arrow 55.

In the present embodiment, an endless belt having a three-layer structure including a base layer 72, an elastic layer 73, and a release layer 74, and formed into a cylindrical shape having a diameter of 50 mm, is used as the fuser belt 71.

A material made of the base layer 72 is not particularly limited, so long as it is excellent in heat resistance property and durability. A heat-resistant synthetic resin can be used as the material of the base layer 72. Preferable examples thereof include polyimide (PI), polyamideimide (PAI), nickel plating, and SUS. These materials are excellent in strength, heat resistance property, and cost performance.

The thickness of the base layer 72 is not particularly limited, but preferably, 30 to 200 μm.

A material of the elastic layer 73 is not particularly limited, so long as it has a rubber elasticity. A material having excellent heat resistance property is preferable. Specific examples thereof include a silicon rubber, fluorine-containing rubber, and fluorosilicon rubber, wherein the silicon rubber that is more excellent in the rubber elasticity is more preferable.

A hardness of the elastic layer 73 is preferably 1 to 60 degrees in JIS-A hardness. When the hardness falls within the range of the JIS-A hardness, a defective fusibility of the toner can be prevented, while preventing the reduction in the strength of the elastic layer 73 and a poor adhesive property. Specific examples of the silicon rubber include a silicon rubber containing one component, two components, or three or more components, a silicon rubber of LTV type, RTV type, or HTV type, and a condensed or addition silicon rubber.

The thickness of the elastic layer 73 is preferably 100 to 200 μm. When the thickness falls within this range, a heat insulating property can be held to be low, while keeping an elastic effect of the elastic layer 73, whereby an energy-saving effect can be exhibited. In the present embodiment, a silicon rubber having JIS-A hardness of 5 degrees is used.

The release layer 74 is made of a layer formed by applying a resin containing a fluorine resin tube or a fluorine resin, and sintering the resultant.

The material of the fluorine resin is not particularly limited, so long as it is excellent in heat resistance property and durability, and weak in adhesion force to the toner. Examples of the material include a PTFE (polytetrafluoroethylene), and PFA (tetrafluoroethylene-perfluoroalkylvinylether copolymer).

The thickness of the release layer 74 is preferably 5 to 50 μm. When the thickness falls within this range, the release layer 74 can follow fine irregularities on the recording medium, while utilizing the elasticity of the elastic layer with an appropriate strength.

The fuser roller 50 is a roller-like member that is supported to be rotatable by an unillustrated support unit, and that rotates in the direction of the arrow 78 at a predetermined speed with the rotations of the pressure roller 60 and the fuser belt 71. In the present embodiment, a roller-like member formed into a cylindrical shape having a diameter of 30 mm, and including a core 51 and an elastic layer 52, is used as the fuser roller 50.

A metal having high thermal conductivity can be used as the metal forming the core 51. Examples of the material include an aluminum and iron.

The material for the elastic layer 52 is not particularly limited, so long as it has a rubber elasticity. A material having excellent heat resistance property is further preferable. Specific examples of the material include a silicon rubber, a fluorine-containing rubber, and a fluorosilicon rubber. Among these materials, a liquid thermosetting silicon rubber is more preferable. It is also preferable that the elastic layer 52 is made into a sponge-like form in order to enhance the heat insulating property of the fuser roller 50. A surface layer 53 may be formed on the elastic layer in order to correct a deviation of the fuser belt 71. With this configuration, a sliding property on the surface of the fuser roller 50 is enhanced, whereby the deviation of the fuser belt 71 can easily be corrected.

The material for the surface layer 53 is not particularly limited, so long as it has an excellent heat resistance property and durability, and has high sliding property. Preferable examples of the material include a fluorine-containing resin material such as PFA (tetrafluoroethylene-perfluoroalkylvinylether copolymer) and PTFE (polytetrafluoroethylene), and a fluorine-containing rubber.

An auxiliary heating unit may be provided in the fuser roller 50. This is for shortening a start-up time until an image formation becomes possible from ON of a power source of the image forming apparatus 1, and preventing a reduction in a surface temperature of the fuser roller 50 caused by a heat transfer to the recording medium 8 during the fusing operation of the toner image.

The heating member 80 is a member having a heat source provided therein, and brought into contact with the fuser belt 71 by an unillustrated pressure unit so as to heat the fuser belt 71. The heating member 80 includes a heat-conductor 81, a sheet heating element 82, a heat insulating member 83, a pressure member 84, and a reinforcing member 85.

Figure 5A:
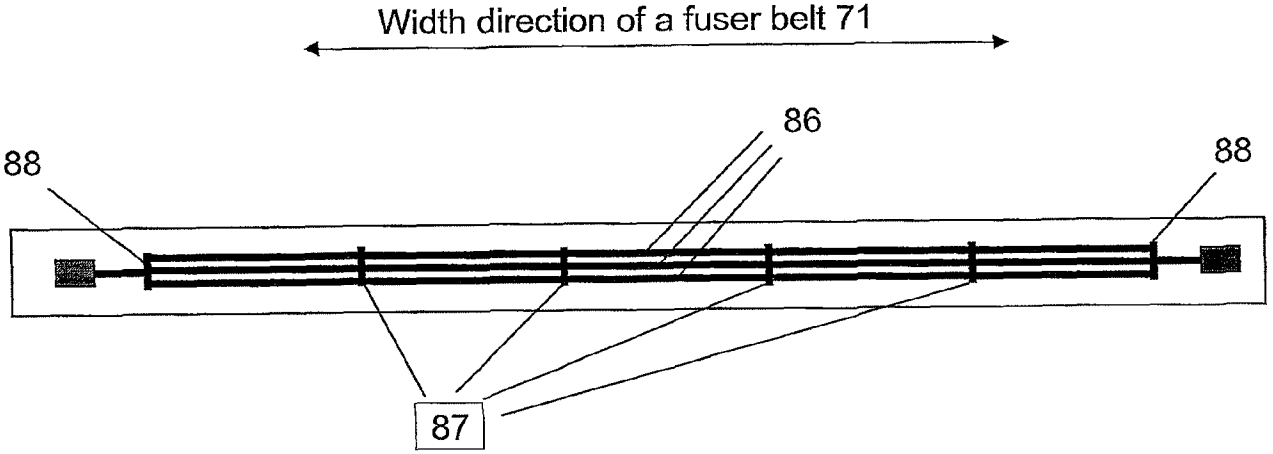
FIGS. 5A and 5B are explanatory views illustrating an example of a detailed configuration of the sheet heating element in the image forming apparatus illustrated in FIG. 1.
Figure 5B:
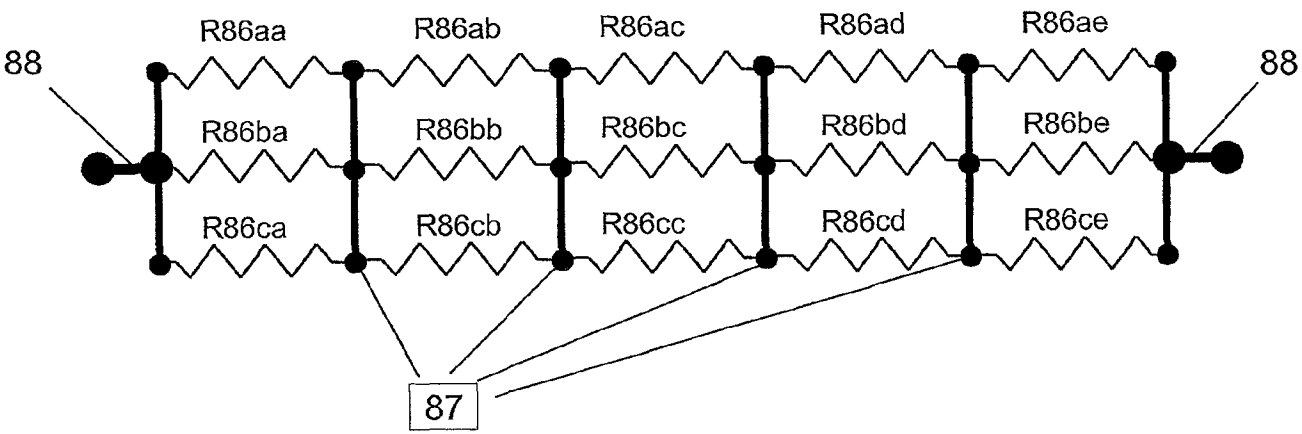

FIGS. 5A and 5B are detailed views illustrating the structure of the sheet heating element 82.

As illustrated in FIG. 5A, the sheet heating element 82 includes plural resistance heating elements 86 made of a silver-palladium (AgPd) on an insulating substrate that is made of a ceramic and formed into a rectangular reed shape viewed in a plane.

The substrate is not particularly limited, so long as it has a heat resistance property, excellent thermal conductivity, and electrical insulating property. Examples of the material include a ceramic material such as an alumina or aluminum nitride. A metal plate, such as SUS, coated by a glass material having an excellent heat resistance property and an electric insulating property can be used.

In the present embodiment, the substrate of 0.8 mm is used. The resistance heating elements 86 are formed by forming a paste made of a conductive material onto the substrate in a predetermined pattern by a method of printing. In the present invention, three straight-line resistance patterns are formed. One end and the other end of each of the resistance heating elements 86 are commonly connected with a terminal electrode 88. Conduction portions 87 are formed between the terminal electrodes at both ends for stabilizing the resistance value in the longitudinal direction thereof as illustrated in the figure. A silver-palladium paste is used as the resistance heating element 86. A sliver paste is used for the conduction portion 87. The resistance heating element 86 and the conduction portion 87 are layers having a thickness of about 10 μm in the present embodiment.

Thereafter, the resultant is put into a sintering furnace to sinter a ceramic sheet under a predetermined sintering condition, and then, the surface of the resistance heating element is coated with an insulating material, such as a glass material, serving as an insulating protection layer, whereby the sheet heating element 82 is completed.

FIG. 5B illustrates an equivalent circuit of the resistance heating layers illustrated in FIG. 5A. The portion between the terminal electrodes 88 is divided into five blocks by four conduction portions 87. The respective blocks are connected in series. Each block is composed of three parallel resistances. For example, the block on the extreme left includes three resistances R86*aa*, R86*ba*, and R86*ca*, those of which are connected in parallel. Therefore, even if there is a variation in the resistance values of the resistances R86*aa*, R86*ba*, and R86*ca*, the variation of a combined resistance having these three resistances connected in parallel is averaged.

The conduction portion 87 that connects the respective blocks has a width of 1 mm. The portion of the substrate corresponding to the width of the conduction portion in the longitudinal direction of the substrate has a resistance value lower than that of the portion of the resistance at both sides of the conduction portion 87. Although the width of the conduction portion 87 is very small, the temperature thereof becomes slightly lower than the temperature of the resistance portion at both sides of the conduction portion, since the conduction portion does not generate heat. The temperature at both ends of the substrate where there is no resistance and the terminal electrodes 88 are formed becomes lower than the temperature at the portion where there is the resistance.

The heat-conductor 81 is a member for transmitting the heat of the sheet heating element 82 to the fuser belt 71. The heat-conductor 81 is not particularly limited, so long as it has a heat resistance property and high thermal conductivity, wherein a metal such as an aluminum or iron is preferable.

It is preferable that the surface of the heat-conductor 81 has a shape having a curvature, since it is in sliding contact with the inner surface of the fuser belt 71. If the curvature is great, the fuser belt 71 cannot follow the shape of the heat-conductor 81. Therefore, a problem might arise that the fuser belt 71 is floated from the heat-conductor 81 at the central part of the heat-conductor 81. Accordingly, the curvature of the heat-conductor 81 is desirably within the range of R10 to 200.

A fluorine resin layer may be formed on the surface of the heat-conductor 81, according to need, in order that the heat-conductor 81 satisfactorily moves in sliding contact with the inner surface of the fuser belt 71.

The pressure member 84 is a member for pressing the sheet heating element 82 against the heat-conductor 81. The pressure member 84 is preferably arranged on at least three portions, which are at both ends, and at the central part.

It is extremely desirable that the pressure member 84 at both ends is arranged at 10 mm or less from the end of the heat distribution pattern. When the pressure member 84 is arranged outward at 10 mm or more from the end of the heat distribution pattern as a conventional structure, the heat-conductor 81 has to be extended to the position of the pressure member 84, which might entail a temperature drop at the end. When the heat-conductor 81 is not extended, the sheet heating element 82 is pushed up, so that the sheet heating element 82 is warped, resulting in that a gap is formed between the heat-conductor 81 and the sheet heating element 82 in the vicinity of the end of the heat-conductor 81. When the gap is formed, the heat of the sheet heating element 82 is not sufficiently transmitted to the heat-conductor 81, with the result that the temperature of the sheet heating element 82 at this portion might rise. As a result, this portion thermally expands, whereby the gap is further increased. When a vicious cycle described above is repeated, the sheet heating element 82 might be broken.

Figure 4:
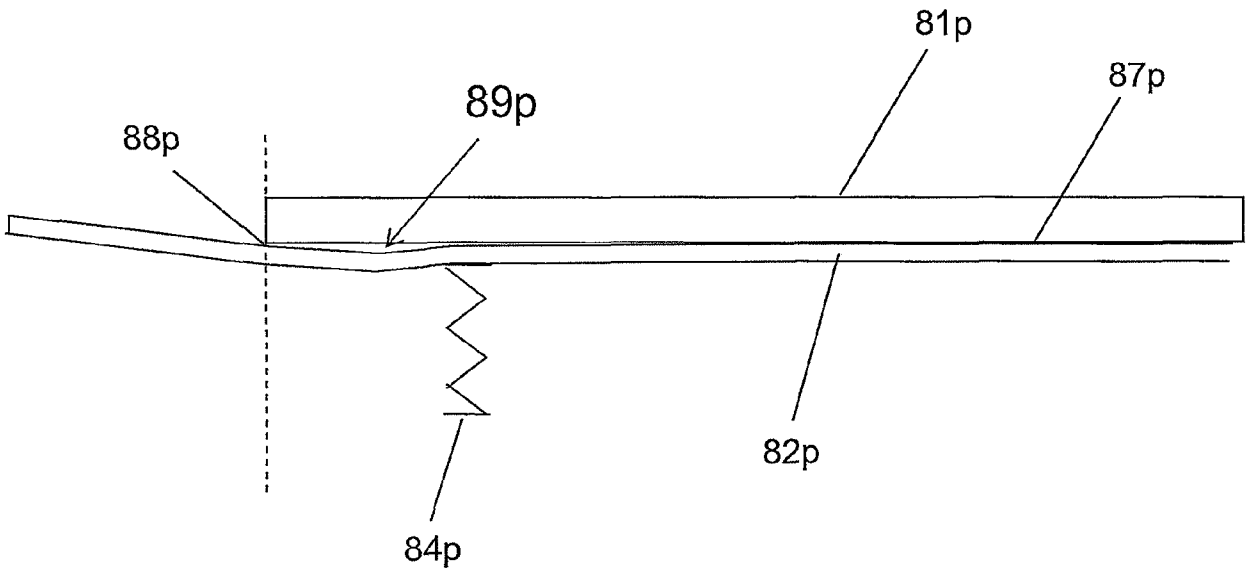
PRIOR ART Fig.4
FIG. 4 is an explanatory view illustrating a state in which a gap is formed between a heat-conductor and a sheet heating element in the vicinity of an end of the heat-conductor in a conventional fusing apparatus.

FIG. 4 is an explanatory view illustrating a state in which a gap is formed between a heat-conductor and a sheet heating element in the vicinity of an end of the heat-conductor in a conventional fusing apparatus. In FIG. 4, suffix "p" to each numeral indicates "prior art". As shown in FIG. 4, when a pressure member 84*p* is arranged inward at 10 mm or more from the end of the heat distribution pattern as a conventional structure, the portion longer than the heat-conductor of the sheet heating element is warped due to heat. Thus, a gap 89*p* is formed between a heat-conductor 81*p* and a sheet heating element 82*p* in the vicinity of the end of the heat-conductor 81*p*. When the gap 89*p* is formed, the heat of the sheet heating element 82*p* is not sufficiently transmitted to the heat-conductor 81*p*, with the result that the temperature of the sheet heating element 82*p* at this portion might rise. As a result, this portion thermally expands, whereby the gap is further increased. When a vicious cycle described above is repeated, the sheet heating element 82*p* might be broken.

The pressure member at the central portion is desirably arranged at the place apart from the conduction portion by 10 mm or more.

When the pressure member is arranged at a place apart from a conduction portion 87*p* by 10 mm or less as a conventional structure, the pressure member might press the conduction portion, which has relatively a low temperature, whereby the high-temperature portion of the sheet heating element 82*p* becomes free. In this case, the sheet heating element 82*p* extends and warps due to a thermal expansion caused by the temperature, resulting in that a gap is formed between the heat-conductor 81*p* and the sheet heating element 82*p*. When the gap is formed, the heat of the sheet heating element 82*p* is not sufficiently transmitted to the heat-conductor 81*p*, with the result that the temperature of the sheet heating element 82*p* at this portion might rise. As a result, this portion thermally expands, whereby the gap is further increased (not shown in FIG. 4). When a vicious cycle described above is repeated, the sheet heating element 82*p* might be broken.

The heat insulating member 83 is arranged between the sheet heating element 82 and the pressure member 84 for preventing the heat of the sheet heating element 82 from diffusing through the pressure member 84. The material for the heat insulating member 83 is not particularly limited, so long as it has an excellent heat resistance property and heat insulating property, wherein an expanded polyimide sheet or an aramid sheet can be used.

The reinforcing member 85 is a member for preventing the heating member 80 from being bent when the heating member 80 is brought into contact with the fuser belt. The reinforcing member 85 is not particularly limited, so long as it is a member having a heat resistance property and high rigidity, wherein a metal such as an iron is preferable.

The pressure roller 60 is brought into pressed contact with the fuser roller 50 through the fuser belt 71 by an unillustrated pressure mechanism at a downstream side in the rotating direction of the fuser roller 50 from the lowermost point of the fuser roller 50 in the vertical direction, so as to form a fuser nip portion 55. The pressure roller 60 is rotated by an unillustrated drive unit. The pressure roller 60 presses the toner, which is in the fused state, against the recording medium 8 so as to promote the fusing of the toner image onto the recording medium 8, when the toner image is heated and fused to the recording medium 8 by the fuser roller 50.

In the present embodiment, a roller member including a core 61, an elastic layer 62, and a surface layer 63, and having a diameter of 30 mm is used as the pressure roller 60. The metal or the materials for the core 51, the elastic layer 52, and the surface layer 53 of the fuser roller 50 can be used for the core 61, the elastic layer 62, and the surface layer 63. The shape of the core 61 is also the same as that of the fuser roller 50.

A heating unit may be provided in the pressure roller 60. This is for shortening a start-up time until an image formation becomes possible from ON of the power source of the image forming apparatus 1, and preventing a reduction in a surface temperature of the pressure roller 60 caused by a heat transfer to the recording medium 8 during the fusing operation of the toner image. A halogen lamp may be used for the heating unit.

The tension roller 77 is a roller member that is supported so as to be rotatable, and that is mounted to apply a tension to the fuser belt 71 by an unillustrated pressure unit. The tension roller 77 rotates with the rotation of the fuser belt 71 in the direction of the arrow 78. A metallic roller made of a metal having high thermal conductivity, such as an aluminum or iron, can be used as the tension roller 77. A fluorine resin layer may be formed on the surface of the metallic roller, according to need. A heat insulting member having excellent heat insulating property such as a silicon sponge may be formed on the surface of the roller in order to prevent the heat from escaping through the metallic roller.

A thermistor 76 is provided to be in proximate to the fuser belt 71 at the downstream side from the contact point between the heating member 80 and the fuser belt 71 in the rotating direction, and at the upstream side from the contact point between the fuser belt 71 and the pressure roller 60. The thermistor 76 detects the temperature of the fuser belt 71. The result of the detection by the thermistor 76 is inputted to a CPU.

The CPU determines whether the temperature of the thermistor 76 falls within a set range or not from the detection result of the thermistor 76. When the temperature of the fuser belt 71 is lower than the set range, the CPU transmits a control signal to the power source connected to the sheet heating element 82 to supply electric power to the sheet heating element 82, in order to facilitate the heat generation. When the temperature of the fuser belt 71 is higher than the ser range, the CPU confirms whether the power is fed to the sheet heating element 82 or not. When the feed of the power is continued, the CPU transmits the control signal for stopping the feed of the power.

The fusing mechanism including the fuser roller 50, the heating member 80, the fuser belt 71, and the pressure roller 60 is controlled by the unillustrated CPU (Central Processing Unit) that control the whole operation of the image forming apparatus 1. The CPU corresponds to the control portion described above.

When receiving an instruction of the image formation, the CPU transmits the control signal to the unillustrated power source that feeds the power to the heating member 80, the sheet heating element 82 mounted in the heating member 80, and the heating unit provided in the pressure roller 60. The instruction of the image formation is inputted from an unillustrated operation panel provided on a top surface of the image forming apparatus 1 in the vertical direction or from an external device, such as a computer, connected to the image forming apparatus 1. The power source receiving the control signal feeds the power to start the sheet heating element 82 and the heating unit.

The sheet heating element 82 and the heating unit heats the surfaces of the fuser roller 50, the heating member 80, the pressure roller 60, and the fuser belt 71 to the corresponding set temperature. A temperature detecting sensor, which is not illustrated and which is provided in the vicinity of the fuser roller 50 and the pressure roller 60, detects that the surfaces of these components reach the corresponding set temperature. When the detection result is inputted to the CPU, the CPU transmits a control signal for rotating the fuser roller 50 to an unillustrated drive unit, thereby rotating the pressure roller 60 in a direction indicated by an arrow 56. With this rotation, the fuser belt 71, the fuser roller 50, and the pressure roller 60 rotate. With this state, the recording medium 8 having a non-fused toner image formed thereon is conveyed to the fuser nip portion 55 from a secondary transfer roller 28 (see FIG. 1). When the recording medium 8 passes through the fuser nip portion 55, the toner composing the toner image is fused and pressurized to be fixed onto the recording medium 8, whereby an image is formed.

The present invention is not limited to the above-mentioned embodiments, and various modifications are possible without departing from the scope described in the claims. Specifically, the embodiments obtained by combining technical means, which are appropriately modified within the scope of the claims, are also included in the technical scope of the present invention.

Experimental Example 1

An experiment described below was carried out in order to confirm an affect by an end of a wiring pattern of a sheet heating element and a pressure position.

The specification of the sheet heating element and the heat-conductor used in the experiment and the pressure position were as stated below.

Sheet heating element: 366 mm (wiring pattern: 320 mm) (the center of the substrate and the center of the wiring pattern agree with each other)

Position of conduction portion: 60 mm, 127 mm, 194 mm, 261 mm (a position of a start of a wiring pattern at one side is defined as 0)

Heat-conductor: 320 mm

Position where pressure member is arranged: 90, 110, 150, 170, 210, 230 mm (fixed)

Figure 6:
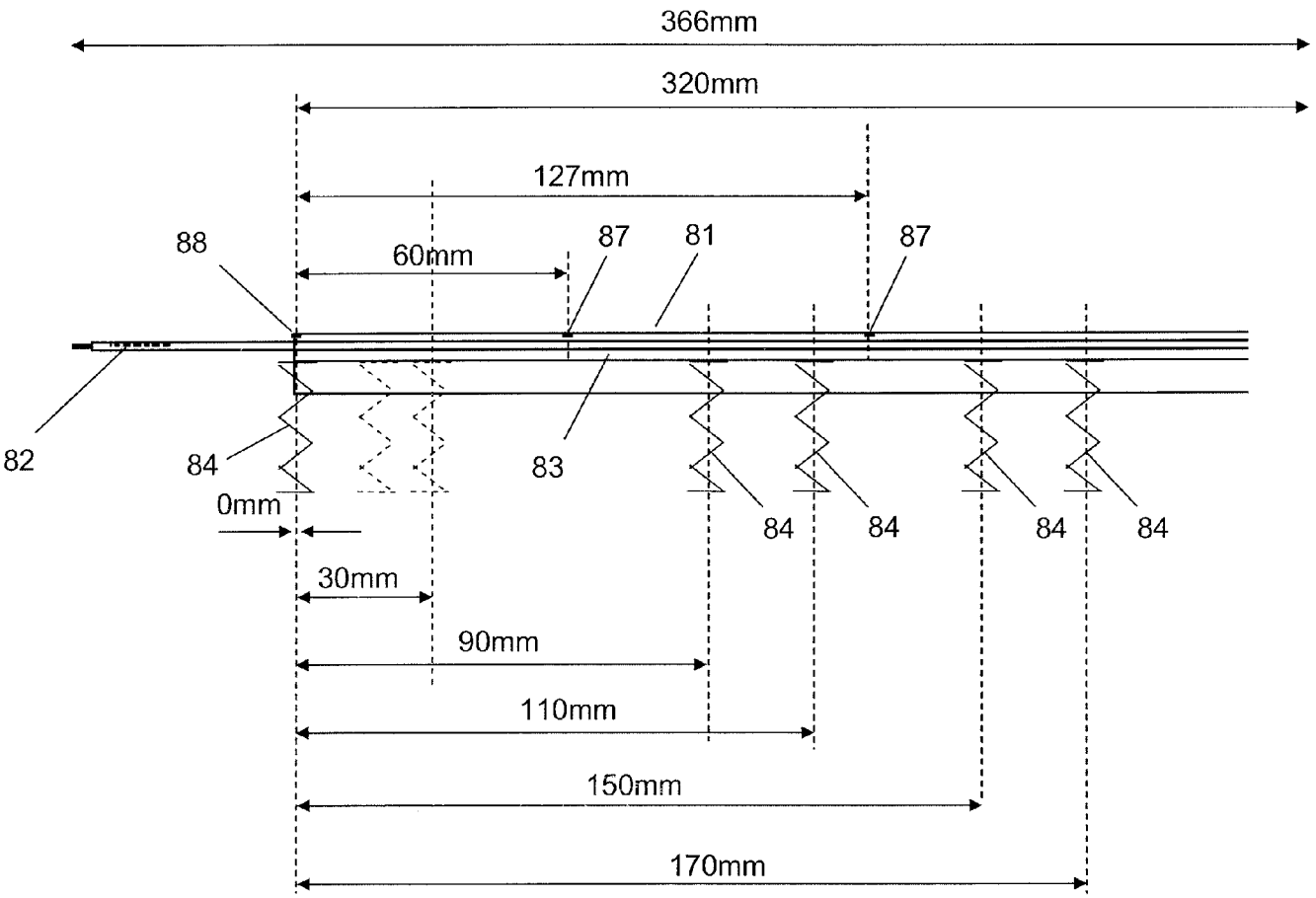
FIG. 6 is an explanatory view illustrating a detail of a pressure position in an experiment example 1 in the present invention.

The pressure position from the end of the wiring pattern of the sheet heating element was changed as 0, 5, 10, 15, and 30 mm (see FIG. 6). The outward direction from the end of the wiring pattern of the sheet heating element was specified as minus, wherein the pressure member was arranged at −5, and −10 mm from the end.

The heating member 80 having the above-mentioned condition was assembled in an experimental apparatus illustrated in FIG. 3.

A test at elevated temperature in which the temperature of the fuser belt was raised to 200° C. from room temperature was repeated 50 times so as to visually confirm the temperature rising performance and the state of the sheet heating element before and after the experiment. Table 1 shows the result. (O: good in temperature rising performance and visual confirmation, Δ: good in temperature rising performance, but no good in visual confirmation, X: no good in temperature rising performance and visual confirmation)

TABLE 1

| Position of pressure member | Result |
|---|---|
| −10 | X |
| −5 | Δ |
| +0 | ○ |
| +5 | ○ |
| +10 | ○ |
| +15 | Δ |
| +20 | X |

When the pressure position at the end of the wiring pattern of the sheet heating element was shifted inward by 10 mm or more, it was visually confirmed that some wiring patterns of the sheet heating element were disturbed. It was also found that the temperature at the broken portion was rapidly raised, so that the temperature rising performance as a whole was reduced.

When the pressure position was arranged at the minus side (outer side), it was visually confirmed that some wiring patterns of the sheet heating element were disturbed. It was also found that the temperature at the broken portion was rapidly raised, so that the temperature rising performance as a whole was reduced.

Experimental Example 2

Figure 7:
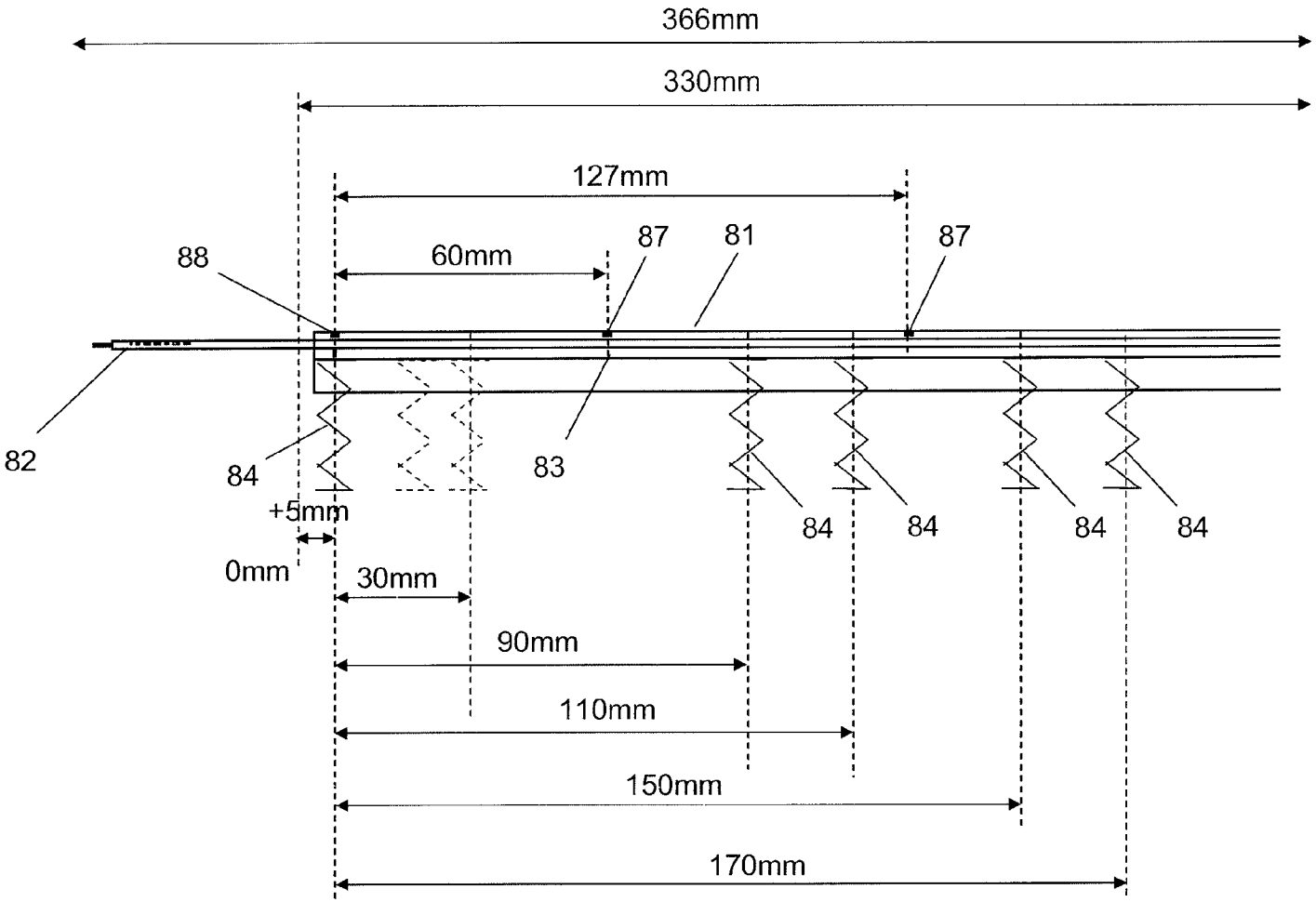
FIG. 7 is an explanatory view illustrating a detail of a pressure position in an experiment example 2 in the present invention.

An experiment similar to the experiment 1 was carried out except that the length of the heat-conductor was extended by 5 mm (FIG. 7). Table 2 shows the result.

Since the heat-conductor was extended by 5 mm, the position where the sheet heating element warped was extended by 5 mm. Therefore, it was considered that the result of the pressure position was shifted by 5 mm. As the heat-conductor is extended more and more from the end of the wiring pattern, heat is more derived, whereby the temperature drop at the end becomes significant. Extending the heat-conductor by 10 mm or more adversely affects the fusing temperature at the end.

TABLE 2

| Length of heat-conductor | Position of pressure member | Result |
|---|---|---|
| +5 | −15 | X |
| | −10 | Δ |
| | −5 | ○ |
| | 0 | ○ |

Experimental Example 3

An experiment described below was carried out in order to confirm an affect by an end of a wiring pattern of a sheet heating element and a pressure position.

Sheet heating element: 366 mm (wiring pattern: 320 mm) (the center of the substrate and the center of the wiring pattern agree with each other)

Position of conduction portion: 60 mm, 127 mm, 194 mm, 261 mm (a position of a start of a wiring pattern at one side is defined as 0)

Heat-conductor: 320 mm

Position where pressure member is arranged: 0, 20, 90, 110, 210, 230, 300, 320 mm (fixed)

Figure 8:
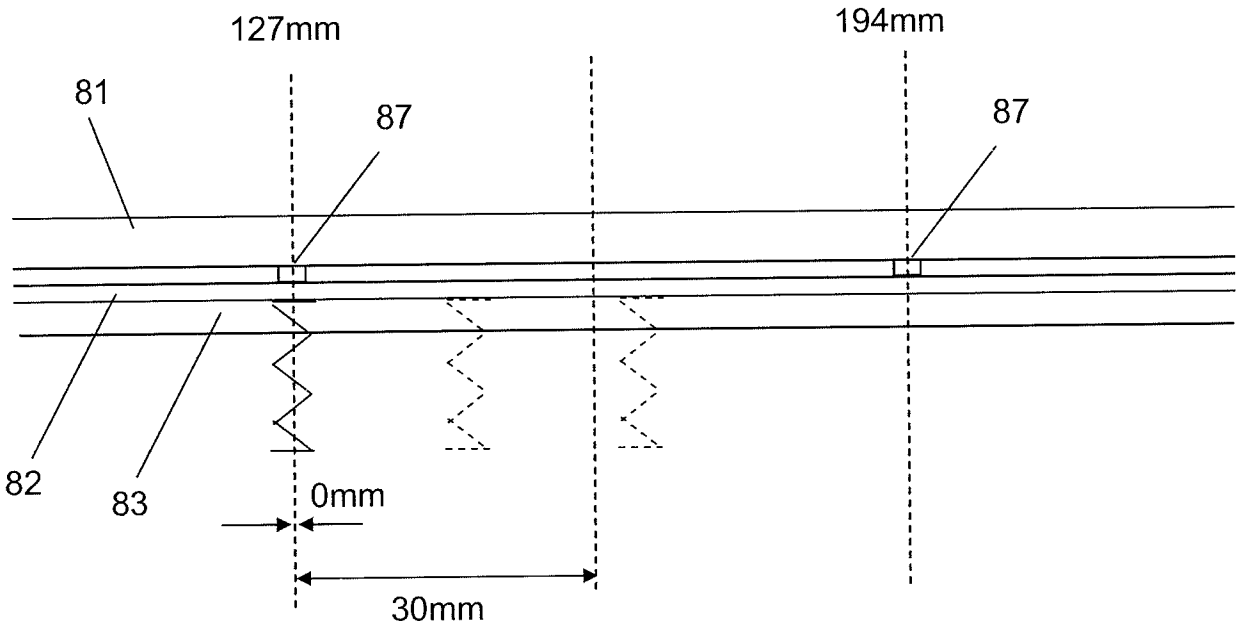
FIG. 8 is an explanatory view illustrating a detail of a pressure position in an experiment example 3 in the present invention.

The pressure position from the conduction portion at 127 mm was changed as 0, 5, 10, 15, 20, 25, and 30 mm (see FIG. 8).

The heating member 80 having the above-mentioned condition was assembled in an experimental apparatus illustrated in FIG. 3.

A test at elevated temperature in which the temperature of the fuser belt was raised to 200° C. from room temperature was repeated 50 times so as to visually confirm the temperature rising performance and the state of the sheet heating element before and after the experiment. Table 1 shows the result. (O: good in temperature rising performance and visual confirmation, Δ: good in temperature rising performance, but no good in visual confirmation, X: no good in temperature rising performance and visual confirmation)

TABLE 1

| Position of pressure member | Result |
|---|---|
| 0 | X |
| +5 | X |
| +10 | Δ |
| +15 | ○ |
| +20 | ○ |
| +25 | ○ |
| +30 | ○ |

When the pressure position was at 5 mm from the conduction portion, it was visually confirmed that some wiring patterns of the sheet heating element were disturbed. It was also found that the temperature at the broken portion was rapidly raised, so that the temperature rising performance as a whole was reduced.

When the pressure position was at 10 mm from the conduction portion, it was visually confirmed that some wiring patterns of the sheet heating element were disturbed, but there was no problem in the temperature rising performance.

Embodiment 2

An embodiment in which the fusing portion 6 is different will next be described.

In this embodiment, a counter member is arranged so as to be opposite to a rigid member serving as the heat-conductor through the fuser belt, which can prevent the formation of a gap between the rigid member and the fuser belt. This configuration can also efficiently transmit the heat from the rigid member to the fuser belt. This configuration can also heat the fuser belt more uniformly.

Figure 9:
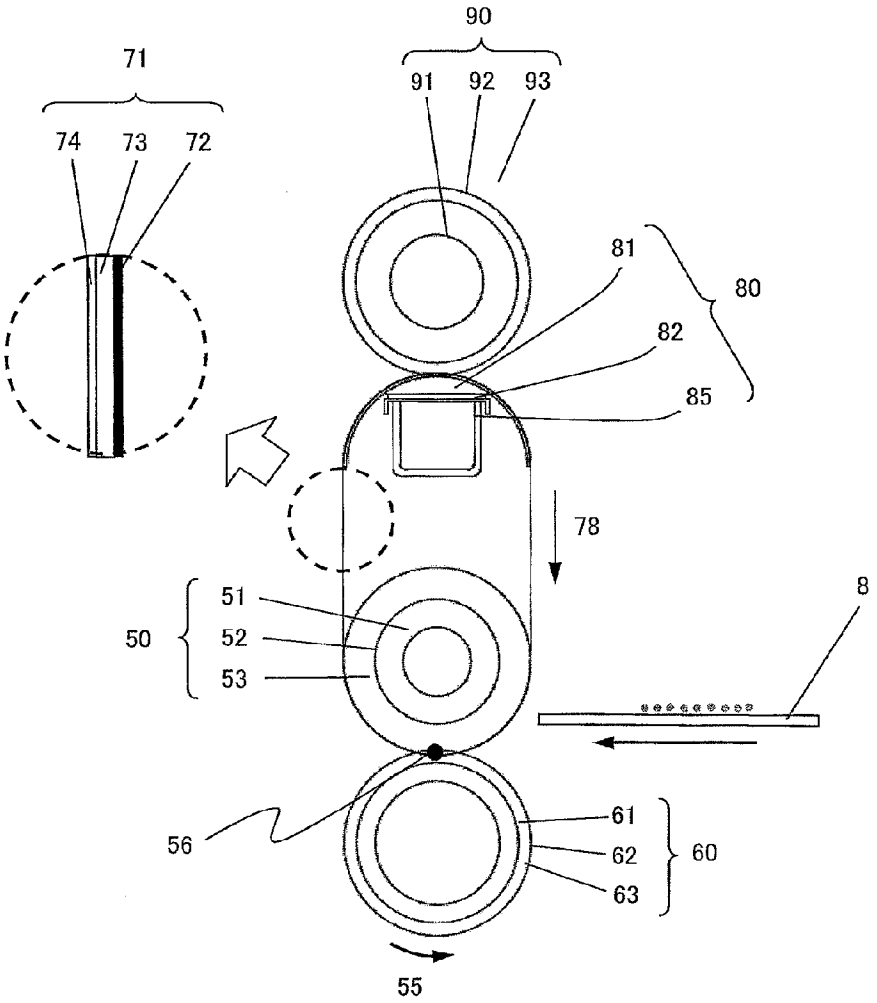
FIG. 9 is a sectional view illustrating an example of a configuration, different from FIG. 3, of the fusing portion in the image forming apparatus illustrated in FIG. 1.

FIG. 9 is a sectional view illustrating the embodiment in which the fusing portion 6 is different from that in FIG. 3. The fusing portion 6 serving as a fusing unit includes the fuser belt 71, the fuser roller 50, the heating member 80, and the pressure roller 60. The detailed description for the components same as those in the embodiment 1 will be skipped, and only a different point will mainly be described below.

In FIG. 9, the fuser belt 71 is an endless belt member that is stretched between the fuser roller 50 and the heating member 80 to form a loop-type moving path. The fuser belt 71 is mounted so as to be in contact with the pressure roller at a press-contact point between the fuser roller 50 and the pressure roller 60. The fuser belt 71 heats and fuses a toner, forming a toner image carried onto a recording medium 8, to be fixed onto the recording medium 8. The fuser belt 71 rotates in the direction of the arrow 78 with the rotation of the pressure roller 60 in a direction of an arrow 56.

The heating member 80 is a member having a heat source provided therein, and mounted so as to apply a tension to the fuser belt 71 by an unillustrated pressure unit. The heating member 80 includes the heat-conductor 81, the sheet heating element 82, and the reinforcing member 85.

A counter member 90 is brought into contact with the heat-conductor 81 through the fuser belt 71 for preventing a defective contact between the fuser belt 71 and the heat-conductor 81.

In the present embodiment, a roller member including a core 91, an elastic layer 92, and a surface layer 93, and having a diameter of 30 mm is used as the counter member 90.

The material for the core 91 is not particularly limited, so long as it has a high rigidity, wherein an aluminum or iron can be used.

The material for the elastic layer 92 is not particularly limited, so long as it has a rubber elasticity, wherein a material having an excellent heat resistance property is preferable. Specific examples of the material include a silicon rubber, a fluorine-containing rubber, and a fluorosilicon rubber. It is also preferable that the elastic layer 92 is made into a sponge-like form in order to enhance the heat insulating property. This structure can reduce a heat capacity of the counter member 90, and can avoid the escape of the heat from the heating member to the core 91 of the counter member 90. Since the heat capacity is small, the affect to the warm-up time can be reduced.

The material for the surface layer 93 is not particularly limited, so long as it can follow the change in the shape of the elastic layer. The material that can remove a toner stain deposited on the fuser belt 71 can also be used. For example, a felt aramid sheet can be used.

Figure 10:
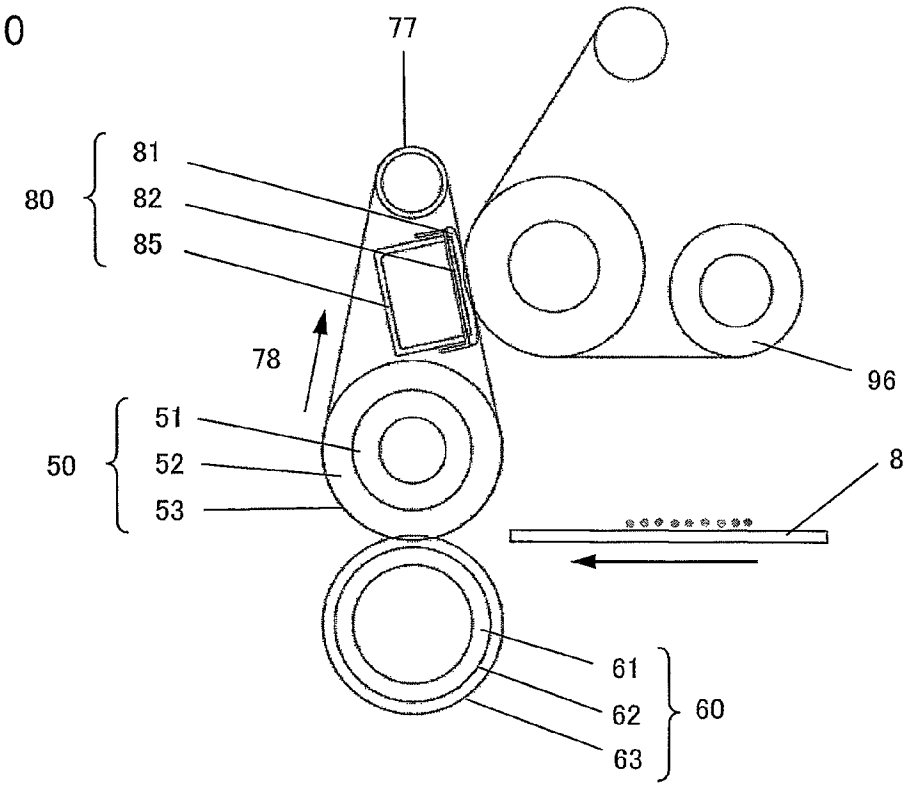
FIG. 10 is an explanatory view illustrating a configuration in which a cleaning web is arranged at a counter member in the fusing apparatus according to the present invention.

The counter member 90 may only have a shape for preventing the defective contact between the fuser belt 71 and the heat-conductor 81. The counter member 90 may have not only the roller shape described above but also a structure having a cleaning web 96 arranged thereto as illustrated in FIG. 10, as well as a structure of a pad type illustrated in FIG. 11.

The pressure roller 60 is brought into pressed contact with the fuser roller 50 through the fuser belt 71 by an unillustrated pressure mechanism at a downstream side in the rotating direction of the fuser roller 50 from the lowermost point of the fuser roller 50 in the vertical direction, so as to form the fuser nip portion 55. The pressure roller 60 is rotated by an unillustrated drive unit. The pressure roller 60 presses the toner, which is in the fused state, against the recording medium 8 so as to promote the fusing of the toner image onto the recording medium 8, when the toner image is heated and fused to the recording medium 8 by the fuser roller 50.

Figure 11:
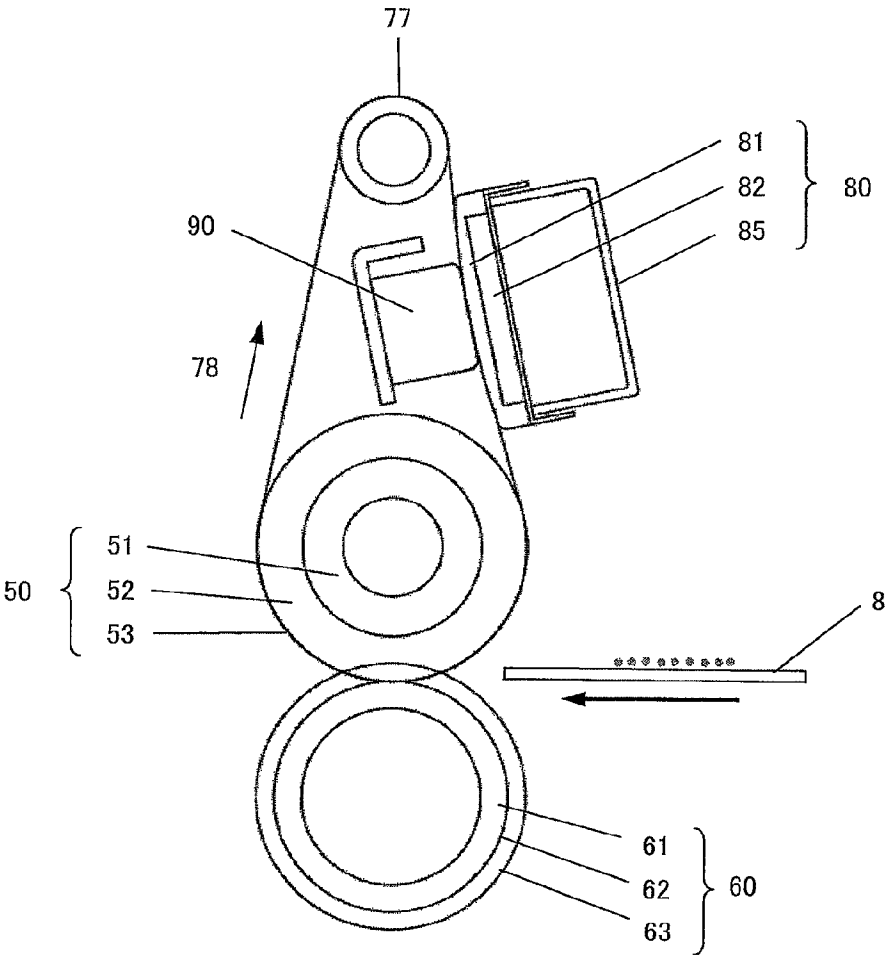
FIG. 11 is an explanatory view illustrating a modification of the fusing apparatus illustrated in FIG. 9.

FIG. 11 illustrates the modification of the configuration illustrated in FIG. 9. There are two different points from the configuration in FIG. 9. Firstly, the member of stretching the fuser belt 71 is changed to a tension roller 77 from the heating member 80. Secondly, the heating member 80 is brought into contact with the fuser belt 71 stretched by the fuser roller 50 and the tension roller 77. These two points are the main different points.

[Configuration Other than Fusing Portion in Image Forming Apparatus]

A configuration of the image forming apparatus 1 except for the fusing portion 6, which has already been described, will next be described.

(Image Forming Portion)

The image forming portion 2 serving as an image forming unit includes image forming units 10*y*, 10*m*, 10*c*, and 10*b*. The image forming units 10*y*, 10*m*, 10*e*, and 10*b* form electrostatic latent images corresponding to a digital signal of respective color phases (hereinafter referred to as "image information"), and develop the electrostatic latent images to form toner images with toners of respective colors. Specifically, the image forming unit 10*y* forms the toner image corresponding to image information of a yellow color, the image forming unit 10*m* forms the toner image corresponding to image information of a magenta color, the image forming unit 10*c* forms the toner image corresponding to image information of a cyan color, and the image forming unit 10*b* forms the toner image corresponding to image information of a black color.

As for the image forming units 10*y*, 10*m*, 10*c*, and 10*b*, the image forming unit 10*y* corresponding to the yellow color will be described as one example, and the description for the other image forming units will be skipped. The different point between the image forming unit 10*y* and the other image forming units is that the image forming unit 10*y* uses a yellow developer, while the other image forming units use a magenta developer, a cyan developer, and a black developer, respectively. Another different point is such that a pixel signal corresponding to a yellow component image from the image information inputted to the image forming portion 2 is inputted to the image forming unit 10*y*, while a pixel signal corresponding to a magenta-component image, a pixel signal corresponding to a cyan-component image, and a pixel signal corresponding to a black-component image are respectively inputted to the other image forming units.

When the image forming unit 10 corresponding to each color is individually indicated, alphabetical indexes, which are y (yellow), m (magenta), c (cyan), and b (black), are attached. The image forming units 10*y*, 10*m*, 10*c*, and 10*b* are arranged in a line in this order in a moving direction (sub-scanning direction) of a later-described intermediate transfer belt 21, i.e., from the upstream side toward the downstream side in a direction indicated by an arrow 27.

Figure 2:
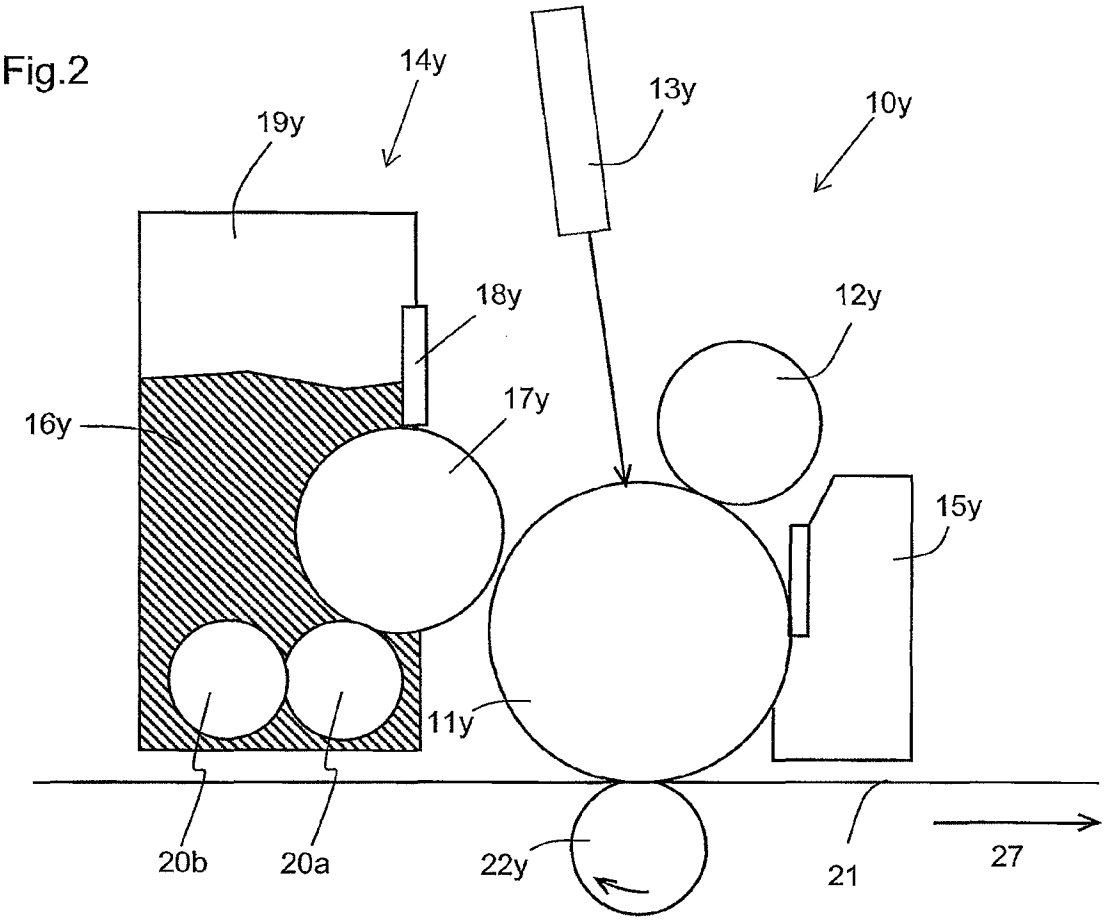
FIG. 2 is an explanatory view schematically illustrating an example of a configuration of an image forming unit in the image forming apparatus illustrated in FIG. 1.

FIG. 2 is a view schematically illustrating the configuration of the image forming unit 10*y*. The image forming unit 10*y* includes a photoconductor drum 11*y*, a charging roller 12*y*, an optical scanning unit 13*y*, a developing apparatus 14*y*, and a drum cleaner 15*y*.

The photoconductor drum 11*y* is an image carrier having a yellow toner image formed on its surface. It is supported so as to be rotatable in an axial direction. The photoconductor drum 11*y* includes a cylindrical, columnar, or thin sheet type (preferably cylindrical) conductive base, and a photoconductor layer formed on the surface of the conductive base.

A photoconductor drum generally used in this technical field can be used as the photoconductor drum 11*y*. For example, a photoconductor drum that includes an aluminum base tube serving as a conductive base and an organic photoconductor layer serving as a photoconductor layer formed on the surface of the aluminum base tube, and that is connected to a GND (ground) potential can be used.

The organic photoconductor layer may be formed to have a charge generating layer including a charge generating substance and a charge transporting layer including a charge transporting substance, or may be formed to have a single layer containing a charge generating substance and a charge transporting substance. Although the thickness of the organic photoconductor layer is not particularly limited, it is preferably 20 μm, for example. A foundation layer may be provided between the organic photoconductor layer and the conductive base. A protection layer may further be provided on the surface of the organic photoconductor layer.

The photoconductor drum 11*y* rotates in a counterclockwise direction on the sheet surface of FIG. 2 at a peripheral speed of 220 mm/s, for example, by a drive unit not illustrated in FIG. 2. The drive unit for the photoconductor drum 11*y* is controlled by a later-described image forming portion control unit. The image forming portion control unit controls the rotation speed of the photoconductor drum 11*y*.

The charging roller 12*y* is a charging unit for charging the surface of the photoconductor drum 11*y* to a potential of a predetermined polarity. The charging unit is not limited to the charging roller 12*y*. Instead of the charging roller 12*y*, a brush-type charging device, a charger-type charging device, or a corona charging device such as a scorotron can be used.

The optical scanning unit 13*y* irradiates a laser light corresponding to yellow image information onto the surface of the photoconductor drum 11*y* that is currently charged. The optical scanning unit 13*y* then forms an electrostatic latent image corresponding to the yellow image information onto the surface of the photoconductor drum 11*y* as a latent image forming unit. A semiconductor laser device is used as a light source of the laser light.

The developing apparatus 14*y* is a developing unit provided to oppose to the photoconductor drum 11*y*. The developing apparatus 14*y* carries a layer of a yellow toner and a carrier included in a dual-component developer 16*y* on a surface of a development sleeve 17*y*. This layer is restricted to have a predetermined thickness by a thickness restricting member 18*y*. The yellow toner develops the electrostatic latent image formed on the surface of the photoconductor drum 11*y*, thereby making the electrostatic latent image visible. A monocomponent developer not containing a carrier can be used as the developer.

The development sleeve 17*y* rotates in a direction reverse to the rotating direction of the photoconductor drum 11*y* at a development nip portion that is proximate to the photoconductor drum 11*y*.

The drum cleaner 15*y* removes and collects the remaining yellow toner after the yellow toner image on the surface of the photoconductor drum 11*y* is intermediately transferred onto the intermediate transfer belt 21. The remaining toner means the toner that is not intermediately transferred onto the intermediate transfer belt 21 to be left on the surface on the photoconductor drum 11*y*.

The image forming unit 10*y* charges the surface of the photoconductor drum 11*y* as allowing the photoconductor drum 11*y* to rotate in the axial direction. The photoconductor drum 11*y* is charged in such a manner that a voltage of −1200 V is applied to the charging roller 12*y* from an unillustrated power source, and a discharge is caused. With this process, the surface of the photoconductor drum 11*y* is charged to −600 V, for example. Then, the image forming unit 10*y* irradiates a laser light, corresponding to the yellow image information, from the optical scanning unit 13*y* onto the surface of the photoconductor drum 11*y* that is currently charged. Thus, an electrostatic latent image having an exposure potential of −70 V and corresponding to the yellow image information is formed.

Subsequently, the image forming unit 10*y* allows the surface of the photoconductor drum 11*y* and the yellow toner carried onto the surface of the development sleeve 17*y* to be very close to each other. A DC voltage of −450 V is applied to the development sleeve 17*y* as a development potential. Due to the potential difference between the development sleeve 17*y* and the photoconductor drum 11*y*, the yellow toner is deposited onto the electrostatic latent image, whereby the yellow toner image is formed on the surface of the photoconductor drum 11*y*. The yellow toner image is temporarily transferred onto the intermediate transfer belt 21 that is brought into pressed contact with the surface of the photoconductor drum 11*y*, and that is driven in the direction of the arrow 27, as described later. The yellow toner remaining onto the surface of the photoconductor drum 11*y* is removed and collected by the drum cleaner 15*y*. After that, the operation of forming the yellow toner image is similarly executed repeatedly.

Dual-component developers 16*y*, 16*m*, 16*c*, and 16*b* used in the image forming apparatus 1 according to the present embodiment will be described below in detail. The dual-component developers 16*y*, 16*m*, 16*c*, and 16*b* include a toner and a carrier.

The toner is made of a toner particle containing a binder resin, a coloring agent, and a release agent. A binder resin generally used in this technical field can be used as the binder resin. Examples thereof include polystyrene, homopolymer of styrene substitute, styrene copolymer, polyvinyl chloride, polyvinyl acetate, polyethylene, polypropylene, polyester, and polyurethane. A single type of the binder resin can be used, or two or more types of the binder resin can be used together.

Among these binder resins, a binder resin having a softening point of 100 to 150° C., and a glass transition point of 50 to 80° C. is preferably used from the viewpoint of a storage stability and durability. The polyester having the softening point and the glass transition point falling within the above-mentioned range is more preferable. The polyester exhibits high transparency in a softened state or in a fused state. When the binder resin is the polyester, the polyester itself is made transparent, when a multicolor toner image formed by overlaying yellow, magenta, cyan, and black toner images is fused onto the recording medium 8 at the later-described fusing portion 6. Therefore, a sufficient color development is attained by a subtractive color mixture.

A toner pigment and a colorant conventionally used in an electrophotographic image forming technique can be used as the coloring agent. Examples of the toner pigment include an organic pigment such as azo pigment, benzimidazolon pigment, quinacridone pigment, phthalocyanine pigment, isoindolinone pigment, isoindoline pigment, dioxazine pigment, anthraquinone pigment, pelylene pigment, pelynone pigment, thioindigo pigment, quinophthalone pigment, and metal complex pigment; an inorganic pigment such as carbon black, titanium oxide, molybdenum red, chrome yellow, titanium yellow, chrome oxide, and Berlin blue; and metal powder such as aluminum powder. A single type of the toner pigment can be used, or two or more types can be used together.

A wax can be used as the release agent. A wax that can generally be used in this technical field can be used as the wax. Examples of the wax include polyethylene wax, polypropylene wax, and paraffin wax.

The toner may contain one or two or more of a charge control agent, flow improver, fusing accelerator, and conductive agent, in addition to the binder resin, the coloring agent, and the release agent.

The toner can be formed by a known method such as a pulverizing method, suspension polymerization method, or emulsion aggregation method. In the pulverizing method, the coloring agent and the release agent are fused and mixed with the binder resin, and the resultant is pulverized to form the toner. In the suspension polymerization method, the binder resin, the coloring agent, and the release agent are uniformly dispersed in a monomer, and the monomers are polymerized to form the toner. In the emulsion aggregation method, the binder resin, the coloring agent, and the release agent are aggregated by an aggregating agent, and fine particles of the obtained aggregation substance are heated to form the toner.

Although a volume average diameter of the toner is not particularly limited, it is preferably within a range of 2 μm or more and 7 μm or less. When the volume average diameter of the toner is appropriately small as described above, a coverage of the toner to the recording medium 8 is increased. Therefore, a high image quality and a reduction in the consumed amount of toner can be achieved with a small amount of the deposited toner.

When the volume average diameter of the toner is less than 2 μm, the fluidity of the toner is reduced, so that the toner is not sufficiently supplied, stirred, and charged during the development operation. Accordingly, the toner amount supplied to the photoconductor drum 11 is lacked, or the toner having a reverse polarity increases, which might prevent the formation of a high-quality image. When the volume average diameter of the toner exceeds 7 μm, a toner particle that has a large diameter and that is difficult to be softened up to the central part during the fusing operation increases. Therefore, the fusibility of the toner image onto the recording medium 8 is deteriorated, and further, the color development of the image is deteriorated. The image becomes dark, particularly in the case of fusing the image onto an OHP sheet.

The toner used in the image forming apparatus 1 is an insulating non-magnetic toner of a negative polarity having a glass transition point of 60° C., the softening point of 120° C., and the volume average diameter of 6 μm. In order to obtain an image density of 1.4 in a reflecting density measured value by 310 manufactured by X-Rite, Incorporated with the use of the toner, an amount of 5 g/m$^2$ is needed on the surface of the recording medium 8.

The toner contains polyester having the glass transition point of 60° C. and the softening point of 120° C. as the binder resin, and contains pigments of the respective colors, as the coloring agent, in an amount of 12 wt. % with respect to the total amount of the toner. The toner also contains low-molecular polyethylene wax having the glass transition point of 50° C. and the softening point of 70° C. as the release agent in an amount of 7 wt. % with respect to the total amount of the toner. The low-molecular polyethylene wax used as the release agent in the toner has the glass transition point and the softening point lower than those of the polyester used as the binder resin.

A magnetic particle can be used as the carrier. Examples of the magnetic particle include a metal such as iron, ferrite, and magnetite, and an alloy of these metals and aluminum or lead. Ferrite is preferable among these materials.

A resin coating carrier formed by coating the magnetic particle with a resin, or a resin dispersion carrier formed by dispersing the magnetic particle into a resin may be used as the carrier. The type of the resin coating the magnetic particle is not particularly limited. Examples of the resin include olefin-based resin, styrene-based resin, styrene acrylic resin, silicon-based resin, ester-based resin, and fluorine-containing polymer resin. The resin used in the resin dispersion type is not particularly limited. Examples of the resin include styrene acrylic resin, polyester resin, fluorine resin, and phenolic resin.

Although the volume average diameter of the carrier is not particularly limited, it is within the range of 30 μm or more and 50 μm or less in order to obtain a high-quality image. The resistivity of the carrier is preferably $10^8$ Ω·cm or more, and more preferably $10^{12}$ Ω·cm or more.

The resistivity of the carrier is obtained as described below. Specifically, the carrier is put into a container having a sectional area of 0.50 cm$^2$, and tapped. Thereafter, a load of 1 kg/cm$^2$ is applied to the carrier put into the container with the use of a weight, and a voltage is applied between the weight and a bottom electrode for generating an electric field of 1000 V/cm. An electric current value in this case is read to obtain the resistivity. When the resistivity of the carrier is low, a charge is injected into the carrier, when the bias voltage is applied to the development sleeve 17*y*, which makes it easier for the carrier particle to deposit onto the photoconductor drum 11*y*. Further, the breakdown of the bias voltage is easy to occur.

An intensity of magnetization (maximum magnetization) of the carrier is preferably within the range of 10 emu/g or more and 60 emu/g or less, more preferably within the range of 15 emu/g or more and 40 emu/g or less. The intensity of the magnetization depends upon the magnetic flux density of the development sleeve 17*y*. Under a general condition of the magnetic flux density of the development sleeve 17*y*, a magnetic constraint force is not exerted, when the intensity of the magnetization is less than 10 emu/g, resulting in that a scattering of the carrier might be caused. When the intensity of the magnetization exceeds 60 emu/g, it becomes difficult to keep a non-contact state with the photoconductor drum 11*y*, in a non-contact development in which a bristle of the carrier becomes too high. In a contact development, a brush mark might be liable to appear on the toner image.

The shape of the carrier is preferably a sphere or elliptic.

The mixture ratio of the toner and the carrier in the dual-component developers 16*y*, 16*m*, 16*c*, and 16*b* is not particularly limited. The mixture ratio may appropriately be selected according to the type of the toner and the carrier.

(Intermediate Transfer Portion)

As illustrated in FIG. 1, the intermediate transfer portion 3 includes an intermediate transfer belt 21, intermediate transfer rollers 22*y*, 22*m*, 22*c* and 22*b*, support rollers 23, 24 and 25, and a belt cleaner 26. In the present embodiment, the intermediate transfer portion 3 and a later-described secondary transfer portion 4 constitute a transfer unit.

The intermediate transfer belt 21 is an image carrier of an endless belt type that is stretched between the support rollers 23 and 25 and the later-described support roller 24 to form a loop-type moving path. The intermediate transfer belt 21 is driven in the direction indicated by the arrow 27 with a peripheral speed substantially equal to the peripheral speeds of the photoconductor drums 11*y*, 11*m*, 11*c*, and 11*b*. Specifically, the intermediate transfer belt 21 is driven in such a manner that an image carrying surface opposing to the photoconductor drums 11*y*, 11*m*, 11*c*, and 11*b* moves toward the photoconductor drum 11*b* from the photoconductor drum 11*y*.

A polyimide film having a thickness of 100 μm can be used for the intermediate transfer belt 21. The material for the intermediate transfer belt 21 is not limited to the polyimide. A film made of a synthetic resin such as polycarbonate, polyamide, polyester, and polypropylene, or various rubbers can be used.

In the film made of the synthetic resin or various rubbers, a conductive material such as furnace black, thermal black, channel black, or graphite carbon is mixed in order to adjust the electric resistance value of the intermediate transfer belt 21. A coating layer made of a fluorine resin composition or a fluorine rubber having a weak adhesion force to the toner may be formed on the intermediate transfer belt 21. Examples of the material for the coating layer include a PTFE (polytetrafluoroethylene) and PFA (tetrafluoroethylene-perfluoroalkylvinylether copolymer). A conductive material may be mixed in the coating layer.

The image carrying surface of the intermediate transfer belt 21 is brought into pressed contact with the photoconductor drum 11*y*, 11*m*, 11*c*, and 11*b* in this order from the upstream side in the rotating direction of the intermediate transfer belt 21. The position of the intermediate transfer belt 21 where the photoconductor drums 11*y*, 11*m*, 11*c*, and 11*b* are brought into contact is an intermediate transfer position of the toner images of the respective colors.

The intermediate transfer rollers 22*y*, 22*m*, 22*c*, and 22*b* are roller members that are provided to oppose to the photoconductor drums 11*y*, 11*m*, 11*c*, and 11*b* via the intermediate transfer belt 21. The intermediate transfer rollers 22*y*, 22*m*, 22*c*, and 22*b* are brought into pressed contact with the surface, reverse to the image carrying surface, of the intermediate transfer belt 21, and are driven to be rotatable in the axial direction by an unillustrated drive unit.

A roller member including a metallic shaft body and a conductive layer formed on the surface of the metallic shaft body is used, for example, for the intermediate transfer rollers 22*y*, 22*m*, 22*c*, and 22*b*.

The metallic shaft body is made of a metal such as a stainless steel. Although a diameter of the metallic shaft is not particularly limited, it is preferably within a range of 8 mm or more and 10 mm or less.

The conductive layer is made of a conductive elastic material. An elastic material generally used in this technical field can be used as the conductive elastic member. Examples of the elastic material include an ethylene-propylene rubber (EPDM), EPDM foam, and urethane foam containing a conductive agent such as carbon black. A high voltage can uniformly be applied to the intermediate transfer belt 21 by the conductive layer.

An intermediate transfer bias having a polarity reverse to the charged polarity of the toner is applied to the intermediate transfer rollers 22*y*, 22*m*, 22*c*, and 22*b* according to a constant voltage control. This is because the toner images formed on the photoconductor drums 11*y*, 11*m*, 11*c*, and 11*b* are transferred onto the intermediate transfer belt 21. With this process, the toner images of yellow, magenta, cyan, and black formed on the photoconductor drums 11*y*, 11*m*, 11*c*, and 11*b* are transferred onto the image carrying surface of the intermediate transfer belt 21 as being overlaid with one another. As a result, a multicolor toner image is formed on the intermediate transfer belt 21. When only some image information of the yellow, magenta, cyan, and block colors is inputted, the toner image is formed only by the image forming unit 10, corresponding to the color of the inputted image information, among the image forming units 10*y*, 10*m*, 10*c*, and 10*b*.

The support rollers 23, 24, and 25 are provided so as to be rotatable in the axial direction by the unillustrated drive unit, and stretch the intermediate transfer belt 21 for rotating the same in the direction indicated by the arrow 27. An aluminum cylindrical member (pipe-type roller) having a diameter of 30 mm and a thickness of 1 mm is used for the support rollers 23 and 25. The support roller 24 is in pressed contact with the later-described secondary transfer roller 28 via the intermediate transfer belt 21 to form a secondary transfer nip portion. The support roller 24 is electrically grounded.

The belt cleaner 26 is a member for removing the toner remaining onto the image carrying surface, after the toner image on the image carrying surface of the intermediate transfer belt 21 is transferred onto the recording medium 8 at the later-described secondary transfer portion 4. The belt cleaner 26 is provided to be opposite to the support roller 25 via the intermediate transfer belt 21.

According to the intermediate transfer portion 3, the high voltage having a polarity reverse to the charged polarity of the toner is uniformly applied to the intermediate transfer rollers 22*y*, 22*m*, 22*c*, and 22*b*. Accordingly, the toner images formed on the photoconductor drums 11*y*, 11*m*, 11*c*, and 11*b* are intermediately transferred onto the predetermined position on the image carrying surface of the intermediate transfer belt 21 as being overlaid with one another, whereby a multicolor toner image is formed. As described later, the toner image is secondarily transferred onto the recording medium 8 at the secondary transfer nip portion. The residual toner and paper powder on the image carrying surface of the inter mediate transfer belt 21 are removed by the belt cleaner 26 after the secondary transfer, whereby the multicolor toner image is again transferred onto the image carrying surface of the intermediate transfer belt 21.

(Secondary Transfer Portion)

The secondary transfer portion 4 includes the support roller 24, and a secondary transfer roller 28. The support roller 24 has a function of stretching the intermediate transfer belt 21 and a function of secondarily transferring the multicolor toner image on the intermediate transfer belt 21 onto the recording medium 8. The secondary transfer roller 28 is a roller member that is in pressed contact with the support roller 24 through the intermediate transfer belt 21, and that is mounted to be rotatable in the axial direction.

The secondary transfer roller 28 includes a metallic shaft body, and a conductive layer formed on the surface of the metallic shaft body. The metallic shaft body is made of a metal such as a stainless steel. The conductive layer is made of a conductive elastic member.

An elastic material generally used in this technical field can be used as the conductive elastic member. Examples of the elastic material include an EPDM, EPDM foam, and urethane foam containing a conductive agent such as carbon black. A power source not illustrated is connected to the secondary transfer roller 28, wherein a high voltage having a polarity reverse to the charged polarity of the toner can uniformly be applied to the secondary transfer roller 28. The press-contact portion of the support roller 24, the intermediate transfer belt 21, and the secondary transfer roller 28 is the secondary transfer nip portion.

According to the secondary transfer portion 4, the recording medium 8 fed from the recording medium feeding portion 5 described later is conveyed to the secondary transfer nip portion in synchronism with the conveyance of the toner image onto the intermediate transfer belt 21 to the secondary transfer nip portion. At the secondary transfer nip portion, the high voltage having the polarity reverse to the charged polarity of the toner is uniformly applied to the secondary transfer roller 28 with the multicolor toner image and the recording medium 8 being overlaid with each other. Thus, the non-fused toner image is secondarily transferred onto the recording medium 8. Then, the recording medium 8 having the non-fused toner image carried thereon is conveyed to the fusing portion 6.

(Recording Medium Feeding Portion)

The recording medium feeding portion 6 includes a recording sheet accommodating tray 42, a recording sheet feed roller 43, conveying rollers 44*a* and 44*b*, and a conveyance path P. The recording sheet accommodating tray 42 accommodates the recording medium 8 that is a recording medium. The recording sheet feed roller 43 feeds the recording medium 8 accommodated in the recording sheet accommodating tray 42. The conveying rollers 44*a* and 44*b* convey the fed recording medium 8 to the secondary transfer portion 4.

Other than the embodiment described above, there can be various modifications for the present invention. It should not be construed that these modifications do not belong to the scope of the present invention. The present invention should include the meaning equivalent to the claims and all modifications within the scope of the claims.

What is claimed is:

1. A fusing apparatus comprising:

a sheet heating element for generating heat to fix a toner image being transferred onto a sheet;

an endless belt being rotatably stretched by a stretching member;

a rigid member for conducting the heat to the endless belt as a heat-conductor, the rigid member being arranged to contact with the sheet heating element and the endless belt respectively; and a pressure member for pressing the sheet heating element against the rigid member, wherein the endless belt is arranged to contact with the sheet, the sheet heating element includes an elongated substrate extending in a widthwise direction of the endless belt perpendicular to the rotating direction thereof, a plurality of parallel resistance heating layers which are formed on a surface of the substrate along a longitudinal direction of the substrate, and at least one conduction portion formed in at least one place of an intermediate region between one end and another of each resistance heating layer to connect the different resistance heating layers, the pressure member is made of an elastic body, the sheet heating element includes a plurality of conduction portions, one end of the rigid member is substantially at a same position as one end of each resistance heating layer in the longitudinal direction of the substrate, and wherein the pressure member presses the sheet heating element against the rigid member at a middle portion between two conduction portions adjacent each other and at a position between the one end of each resistance heating layer and the conduction portion near the end of each resistance heating layer.

2. The fusing apparatus according to claim 1, wherein the pressure member presses the sheet heating element against the rigid member at a position that is between two conduction portions adjacent each other and is more than or equal to 10 mm away from both of conduction portions.

3. The fusing apparatus according to claim 1, wherein the pressure member presses the sheet heating element against the rigid member at a middle portion between the one end of each resistance heating layer and the nearest conduction portion from the end of each resistance heating layer.

4. The fusing apparatus according to claim 1, wherein the pressure member presses the sheet heating element against the rigid member at a position that locates between the one end of each resistance heating layer and the nearest conduction portion from the end of each resistance heating layer and that locates anywhere within more than or equal to 10 mm from the end of each resistance heating layer.

5. The fusing apparatus according to claim 1, wherein the sheet heating member element has a resistance heating layer made of silver and palladium with a thickness of about 10 μm on a ceramic substrate having a thickness of about 0.8 mm.

6. The fusing apparatus according to claim 1, wherein the rigid member is made of an aluminum.

7. An image forming apparatus that comprises the fusing apparatus according to claim 1.

8. A heating apparatus comprising:

a sheet heating element for generating heat to fix a toner image being transferred onto a sheet, the sheet heating element including an elongated substrate, a plurality of parallel resistance heating layers which are formed on a surface of the substrate along a longitudinal direction of the substrate and arranged parallel to one another, and at least one conduction portion formed in at least one place of an intermediate region between one end and another of each resistance heating layer to connect the different resistance heating layers;

a rigid member in contact with an object to be heated for conducting the heat from the sheet heating element to the object; and a pressure member for pressing the sheet heating element against the rigid member, wherein the pressure member is made of an elastic body, the sheet heating element includes a plurality of conduction portions, one end of the rigid member is substantially at a same position as one end of each resistance heating layer in the longitudinal direction of the substrate, and wherein the pressure member presses the sheet heating element against the rigid member at a middle portion between two conduction portions adjacent each other and at a position between the one end of each resistance heating layer and the conduction portion near the end of each resistance heating layer.

* * * * *